US011028651B2

(12) United States Patent
Luo et al.

(10) Patent No.: US 11,028,651 B2
(45) Date of Patent: Jun. 8, 2021

(54) DRILLING RIG

(71) Applicant: SICHUAN HONGHUA PETROLEUM EQUIPMENT CO., LTD., Sichuan (CN)

(72) Inventors: Rui Luo, Sichuan (CN); Ting Zhang, Sichuan (CN); Xiaowu Ou, Sichuan (CN); Qionghua Yang, Sichuan (CN); Yuegang Xu, Sichuan (CN); Guixuan Li, Sichuan (CN); Hongke Xia, Sichuan (CN); Wei Zhang, Sichuan (CN)

(73) Assignee: SICHUAN HONGHUA PETROLEUM EQUIPMENT CO., LTD., Sichuan (CN)

( * ) Notice: Subject to any disclaimer, the term of this patent is extended or adjusted under 35 U.S.C. 154(b) by 61 days.

(21) Appl. No.: 16/470,075

(22) PCT Filed: Jan. 16, 2017

(86) PCT No.: PCT/CN2017/071208
§ 371 (c)(1),
(2) Date: Jun. 14, 2019

(87) PCT Pub. No.: WO2018/107557
PCT Pub. Date: Jun. 21, 2018

(65) Prior Publication Data

US 2019/0316421 A1 Oct. 17, 2019

(30) Foreign Application Priority Data

Dec. 16, 2016 (CN) ..... 201611169704.7

(51) Int. Cl.
*E21B 15/00* (2006.01)
*E04H 12/34* (2006.01)

(52) U.S. Cl.
CPC ..... *E21B 15/00* (2013.01); *E04H 12/34* (2013.01)

(58) Field of Classification Search
CPC . E21B 15/00; E21B 7/00; E21B 19/14; E21B 19/16; E21B 7/023; B66C 13/08; B66D 1/08; E04H 12/34
See application file for complete search history.

(56) References Cited

U.S. PATENT DOCUMENTS 4,448,246 A 5/1984 Guier
4,684,306 A * 8/1987 Brewer ..... E21B 19/14 166/85.5

(Continued)

FOREIGN PATENT DOCUMENTS

CN 2644655 Y 9/2004
CN 2756806 Y 2/2006

(Continued)

*Primary Examiner* — Daniel P Stephenson
(74) *Attorney, Agent, or Firm* — Novick, Kim & Lee, PLLC; Allen Xue

(57) ABSTRACT

A drilling rig includes a base section, a first section, a second section, a third section and a fourth section. For the base section upper region, a fixed pulley block and a guide pulley are installed. Except for the fourth section-crown block section, each section lower region is installed with a lifting lug for a movable pulley block installation for substantially vertical lifting. The crown block section is installed substantially vertical; the subsequent section is located substantially horizontal with the section front pillar upper region connecting to the previous section front pillar lower region. The previous section is substantially vertical lifted to draw the next section skidding into the base section and lifting substantially vertical with the previous section pillar lower region connected to the next section pillar upper region.

10 Claims, 23 Drawing Sheets

(56) References Cited

U.S. PATENT DOCUMENTS

| | | | | |
|---|---|---|---|---|
| 6,594,960 | B2 * | 7/2003 | Brittain | E21B 15/00 175/202 |
| 9,869,109 | B2 * | 1/2018 | Thiessen | E21B 15/00 |
| 9,938,777 | B2 * | 4/2018 | Sigmar | E21B 7/02 |
| 10,053,934 | B2 * | 8/2018 | Keogh | E21B 19/24 |
| 2005/0126800 | A1 | 6/2005 | Orr et al. | |
| 2015/0107165 | A1 | 4/2015 | Petrello et al. | |
| 2018/0238127 | A1 * | 8/2018 | Berry | E21B 19/06 |
| 2018/0328112 | A1 * | 11/2018 | Berry | E21B 3/02 |
| 2019/0316421 | A1 * | 10/2019 | Luo | E21B 15/00 |
| 2019/0368279 | A1 * | 12/2019 | Donnally | E21B 15/00 |

FOREIGN PATENT DOCUMENTS

| | | | |
|---|---|---|---|
| CN | 201221322 | Y | 4/2009 |
| CN | 201874475 | U | 6/2011 |
| CN | 203296707 | U | 11/2013 |
| CN | 204096979 | U | 1/2015 |
| CN | 105178875 | A | 12/2015 |
| CN | 206319834 | U | 7/2017 |

* cited by examiner

DRILLING RIG

TECHNICAL FIELD

The present application is generally directed to a drilling rig assembly. Particularly, the present application relates to a middle-deep well drilling rig suitable for mountainous and hilly regions where well site is constraint.

BACKGROUND

The background description provided herein is for the purpose of generally presenting the context of the disclosure. Work of the present named inventors, to the extent it is described in this background section, as well as aspect of the description that may not otherwise qualify as prior art at the time of filing, are neither expressly nor implied admitted as prior art against the present disclosure.

So far, K-type or A-type mast drilling rig is substantially horizontal installed and lifted by winch or hydraulic cylinder, which occupies large area. Drilling rig with helical or box-on-box type substructure needs heavy workload and more operation skills for installation. Of which the mast is transported and installed with sheets and the substructure is transported and assembled with parts requiring more trucks for more cost. And it is time-consuming and labor-consuming to install the mast and the substructure on site. And equipments-hook block assembly, top drive, rotary table and the like are installed after the mast and the substructure ready. Therefore, the drilling rig installation demands more time.

As disclosed by a Chinese patent CN2644655Y, a K-type self-elevating mast of which each section is an integrated one lifted substantially vertical and sequentially by its own lifting mechanism, location device and guide device to relief the installation. The section is substantially vertical hoisted into the base section for lifting which is not only requiring a larger base section door which is not good for substructure lifting and installing, but also causes heavy workload for operation. In addition, due to limitation of hydraulic cylinder stroke and stringing way and layout, the lifting mechanism of the mast can be merely for shorter sections. Thus a middle-deep well drilling rig should be divided into more sections.

SUMMARY

This invention relates to a drilling rig and a method for a drilling rig installation.

The invention provides a drilling rig, the drilling rig comprising:

at least two lifting devices;

a crown block;

a traveling block;

a top drive;

a mast;

a substructure;

a racking platform;

the mast comprises a K-type base section and a first section as well as a second section and a third section and a fourth section;

the K-type base section connects to the substructure;

the crown block is installed on the fourth section top and the traveling block connects to the crown block;

the third section is installed with the racking platform;

the second section connects to the third section, and the first section connects to the second section, and the first section connects to the base section;

for the fourth section and the third section as well as the second section and the first section, each section lower region is provided with lifting lug and pin hole for adjacent section pin connection;

lifting lug and pin hole are provided with the fourth section front and rear pillar lower region;

lifting lug and pin hole are provided with the third section and the second section front pillar and rear pillar upper region and lower region;

lifting lug and pin hole are provided with the first section pillar upper region;

a fixed pulley block and a guide pulley connect to the base section upper region;

a movable pulley block connects to a substantially vertical section (the fourth section, the third section, the second section, the first section) lifting lug lower region for the section (the fourth section, the third section, the second section, the first section) lifting;

after a lifting steel wire rope wound from the lifting devices, the rope winds around the guide pulley and the movable pulley block as well as the fixed pulley block, and the rope head fixes to the top of the movable pulley block.

Said substructure comprises a middle module with a hydraulic rotary table and a middle base as well as a right transportable module and a left transportable module, wherein the left transportable module comprises a left bottom base and a left top base, the right transportable module comprises a right bottom base and a right top base; a substructure bottom comprises a right bottom base and a left bottom base and a pull rod; the pull rod connects to the right bottom base and the left bottom base; the base section connects to the substructure bottom, and a substructure top which comprises the right top base and the left top base as well as the middle module is lifted by the lifting devices along the guidance of the base section.

Said mast is a K-type mast with the mast bottom section larger than mast top section; and a fourth outer frame fits with the fourth section, a third outer frame fits with the third section, a second outer frame fits with the second section, a first outer frame fits with the first section, and a guide rail strip made from a wear-resistant material is installed on the third section and the second section as well as the first section front and rear pillar and on the surface of the fourth outer frame, and an aligning plate is fixed on the front and rear pillar of the base section, and the guide rail strip skids on the aligning plate during section lifting.

Said lifted section is supported by supporting block assembly comprising of supporting block, handle and cushion block; the cushion block connects to the base section cross beam, the supporting block is hinged with the front pillar and the rear pillar of the base section, the handle connects to the supporting block, the handle is pulled to drive the supporting block to rotate around hinge until a supporting block bottom touches the cushion block.

Said rig further comprising a clamping block assembly; the base section is installed with the clamping block assembly above the supporting block to clamp the first section lower beam after lifted.

Said rig further comprising a pair of movable door bolts installed with the base section two front pillars to hold and align the lifted section.

Said rig further comprising two winches; the base section is installed with one winch on each of the base section lower region side.

Said rig further comprising a mounting rack; the mounting rack comprises a rack body and a guide rail as well as a supporting leg and a platform guide rail; if any of three sections (the third section and the second section as well as the first section) needs lifting, the section is installed with a pulley in pin hole of the section rear pillar, and the pulley is driven to skid on the guide rail and the platform guide rail of the mounting rack during the adjacent upper section substantially vertical lifting.

Said rig further comprising a guide rail and two guide rail grooves; the guide rail is installed on the base section pillar outer surface, and the two guide rail grooves are provided with the substructure left top and right top door, the substructure top guide rail grooves skid on the guide rail for lifting, and at least two walking devices walking in multi-direction are installed on a bottom of a right bottom base and a left bottom base of the substructure.

Said rig further comprising walking devices; the walking devices are installed on a bottom of a right bottom base and a left bottom base of the substructure; said lifting devices are hydraulic winch or hydraulic cylinder installed on the substructure bottom.

The present disclosure, in one or more embodiments, relates to a mast with sections instead of sheets. The section is directly loading in a truck for transportation or simply divided into two parts and loading in a truck for transportation to avoid dividing into sheets. For example, the fourth section, which is installed with a crown block connected to a traveling block, is directly loading. For example, the base section is divided into two modules-a base top section and a base bottom section, of which the base bottom section is divided into two substantially rectangular frame structures which are substantially parallel and the base top section is simply divided into two substantially equal parts.

The present disclosure, in one or more embodiments, relates to a method of building a mast with sections by simple operation on site as below:

Installing a substructure, erecting a base section and fixing the base section to the substructure, substantially vertical lifting a fourth section to the base section front door by an hoist, and slowly pushing the fourth section into the base section, substantially horizontal setting a third section, a second section and a first section into the base section door sequentially, connecting a pin hole in a upper region of a front pillar of a substantially horizontal section to a pin hole in a lower region of a front pillar of a adjacent substantially vertical section by a pin, and installing a pulley with a pin hole of the adjacent substantially vertical section rear pillar, substantially vertical lifting the adjacent substantially vertical section so as to drive the next substantially horizontal section to skid into the base section. Aligning a pin hole in a lower region of the rear pillar of the substantially vertical lifted section with a pin hole in a upper region of a rear pillar of the next section and connected to a pin, and dismounting the movable pulley block from the substantially vertical lifted section lifting lug and installing the movable pulley block with the next substantially vertical lifted section. After the first section and the second section as well as the third section and the fourth section lifted, fixing the upper region of the first section to the base section, lifting the top drive above the substructure and aligning the center of the top drive with the borehole center, descending the traveling block to the first section by the winch, and connecting the traveling block to the top drive, starting a winch to lift the traveling block and the top drive, and continuing to lift the first section by the lifting devices, and fixing the lower region of the first section to the base section, so that the mast is lifted and installed. Dismounting the mast with a process substantially reverses to the mast installation sequence. The mast is convenient and rapid for transportation and installation to improve working efficiency, and furthermore, to save the well site space, and subsequently, to reduce cost.

The present disclosure, in one or more embodiments, relates to a method. Of which a third section, a second section and a first section are drawn substantially horizontal into a base section door, and the door of the base section is much smaller than that of direct substantially vertical drawn into. The substantially vertical section is substantially vertical lifting actively so that an adjacent substantially horizontal section is driven to skid into the base section and passively lifted substantially vertical to reduce the substantially vertical manual operation. In addition, a fixed pulley block and a guide pulley are installed with the base section upper region, a movable pulley block is installed on a lifting lug of a substantially vertical section which connects to the adjacent substantially horizontal section, and a lifting steel wire rope winds from a lifting device, then winds around the guide pulley and then winds around the movable pulley block and the fixed pulley block, and the rope head is fixed to a top of the movable pulley block. With an application of a stringing mode of lifting the lifting steel wire rope and a lifting system, a relatively higher lifting height is allowable and relatively less lifting power consumed, so that the section, which is relatively longer, is conveniently lifted, and it is more suitable for the deep-well drilling rig.

The present disclosure, in one or more embodiments, relates to a substructure made of a middle module which comprises a hydraulic rotary table and a middle substructure, a right transportable module and a left transportable module, wherein the left transportable module comprises a left bottom base and a left top base and the right transportable module comprises a right bottom base and a right top base. A substructure bottom comprises a right bottom base and a left bottom base and a pull rod. The pull rod connects the right bottom base and a left bottom base. A substructure top comprises a right top base and a left top base as well as a middle module. The base section connects to the substructure bottom. The substructure top is lifted by a lifting device along a guidance of the base section. The substructure comprises a right transportable module and a left transportable module as well as the middle module and a pull rod. The substructure with separate module is simple for installation, of which each module is independently transported or directly loading in a truck or loading of being simply divided into two pieces.

The present disclosure, in one or more embodiments, relates to a middle module which comprises a hydraulic rotary table and a middle base. A left transportable module and a right transportable module are substantially the same structure and are substantially symmetrical about a middle module.

A substructure is installed as below:

Drawing a borehole central line on site, setting a left transportable module and a right transportable module in place, and connecting a right bottom base and a left bottom base to a pull rod to build the substructure bottom, and lifting a middle module between a left top base and a right top base and connecting the left top base to the right top base and the middle module to build a substructure top. The substructure top and the substructure bottom are drawn by such device as a hydraulic cylinder, a winch and the like for separation and for the substructure top lifting along a guidance of a base section. So the substructure is convenient and rapid for transportation and installation to improve working efficiency. And which is good for well site saving and cost reducing.

The present disclosure, in one or more embodiments, relates to a mast (a K-type one—a front-opening type or a door) which comprises a base section and a first section and a second section as well as a third section and a fourth section for middle-deep well drilling with bottom section larger than top section. A third outer frame fits the third section. A second outer frame fits the second section. A first outer frame fits the first section. A guide rail strip made from a wear-resistant material is installed on a surface of a front and a rear pillar of the third section and the second section and the first section as well as the fourth outer frame. Install aligning plates on a front and rear pillar of the base section, and the guide rail strip skids on a surface of the aligning plate during lifting. The fourth outer frame is substantially the same structure with the third outer frame, the second outer frame and the first outer frame, so the previous section (the previous section is immovably connected to the section/sections mentioned above and moves together with the section/sections) is drawn through the base section by substantially the same method so as to drive an adjacent section. In addition, the guide rail strip is installed on a front and rear pillar of the third section, the second section and the first section and the fourth outer frame is fitted with the aligning plate on a front and rear pillar of the base section, so that the sections can be lifted smoother through the base section.

Preferably, a drilling rig comprises a supporting block assembly for supporting a section on an upper region of a base section. The supporting block assembly comprises a supporting block, a handle and a cushion block. The cushion block is installed on a cross beam of the base section. The supporting block is hinged with a front supporting pillar and a rear supporting pillar of the base section. The handle is pulled to drive the supporting block to rotate until a supporting block bottom touches the cushion block. The supporting block assembly is set on the base section upper region. Four supporting block assemblies are set substantially horizontal and laterally symmetrical for support during lifting. By pulling the handle, the supporting block rotates around a hinge. After the supporting block bottom drops on the cushion block located on a cross beam of the base section, the supporting block assembly supports the sections in the base section inner frame to avoid dropping. And lifted sections are temporarily stable with the supporting block assembly for section connecting.

Preferably, a clamping block assembly clamping a bottom beam of a first section is additionally installed above a supporting block assembly. And subsequently, a base section and a first section and a second section as well a third section and a fourth section are lifted and fixed. The sections (the first section and the second section as well as the third section and the fourth section) are free from the influence of a clamping block assembly and smoothly lifted and/or descend through the base section if the clamping block assembly free.

Preferably, the base section front pillars are additionally installed with no less than one pair of movable door bolts for aligning and fastening a first section and a second section as well as a third section and a fourth section. The movable door bolts can be extended and retracted. If extended, the first section and second section as well as the third section and the fourth section set in the base section are aligned and fastened. If retracted, the K-type base section is free for the first section and second section as well as the third section and the fourth section smoothly going through.

Preferably, there are small winches for pulling a section into a base section and pulling a section substantially vertical by a rope set on two sides of a lower region of the base section. The small winches are set on two rear pillars lower region of the base section for pulling a section into an inner frame of the base section and pulling a section substantially vertical. Pins are driven into a rear pillar pin hole of an adjacent section aligned with a rear pillar pin hole of the previous section.

Preferably, a drilling rig further comprises a mounting rack which comprises a rack body, a guide rail, a supporting leg and a platform guide rail. During lifting of a third section, a second section and a first section, a pulley is installed with a pin hole of a rear pillars and an adjacent section. The pulley is driven to skid on a guide rail and a platform guide rail of the mounting rack. The mounting rack supports the section during installation. If needed, the platform guide rail is installed on a surface of a middle base of a substructure which can be an extension of the guide rail. The pulley is installed with a rear pillar pin hole during the third section, the second section and the first section lifting, and the pulley skids on the guide rail and the platform guide rail for smoothly going through the K-type base section.

Preferably, a guide rail is installed on an outer surface of a base section pillar. And a door and a guide rail groove are provided of a left and a right top base of a substructure. A substructure top is lifted with the guide rail groove skidding on the guide rail of the base section. And a walking device which walks in multi-direction is installed on a bottom side of a right and a left bottom base of a substructure. With the guide rail groove skidding on the guide rail, the lifting of the substructure on the base section becomes smoother.

Preferably, walking devices which walk in multi-direction is installed on a bottom side of a right and a left bottom base of a substructure. And lifting devices are hydraulic winches or hydraulic cylinders which are set on the substructure bottom. By internally integrating walking devices and lifting devices, the walking devices and the lifting devices work together with a right transportation module and a left transportation module of the substructure to avoid dismounting during walking.

DETAILED DESCRIPTION

Figure 1:
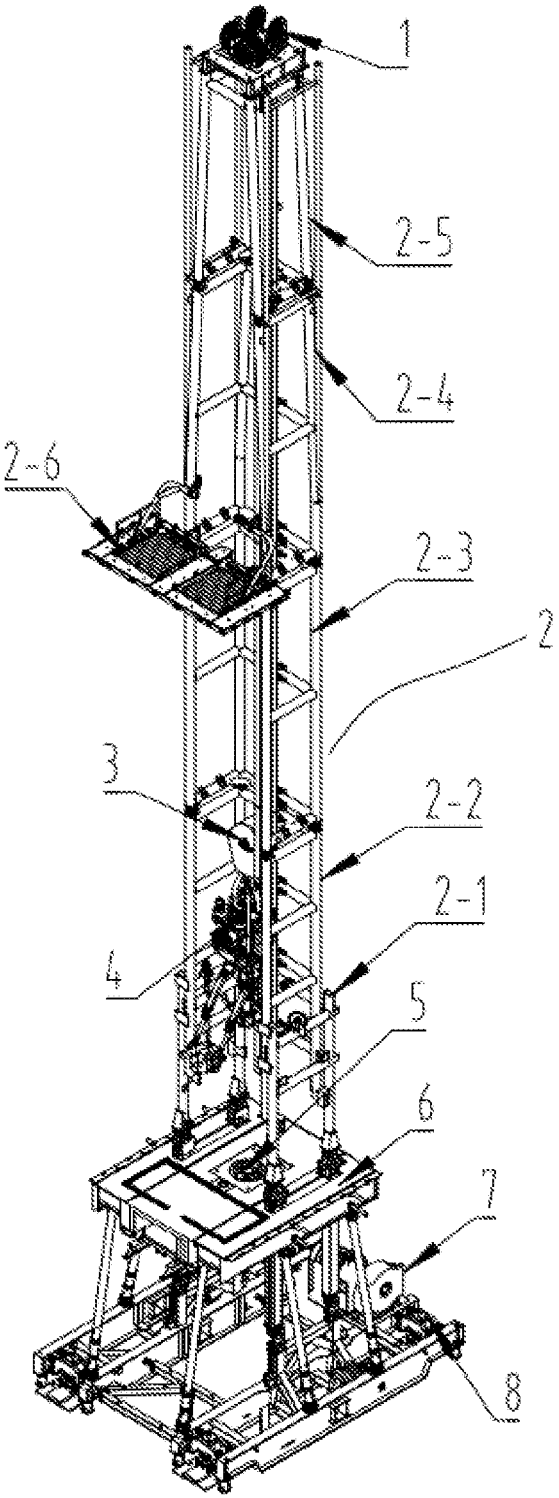
FIG. 1 is a structural view of a drilling rig, according to one or more embodiments.

As shown in FIG. 1, a drilling rig comprises a crown block 1, a mast 2, a traveling block 3, a top drive 4, a hydraulic rotary table 5, a substructure 6, a direct driven winch 7 and a walking device 8, a base section 2-1, a first section 2-2, a second section 2-3, a third section 2-4, a fourth section (2-5) and a racking platform 2-6. The mast 2 is a K-type mast (a front-open mast) which is made of the base section 2-1, the first section 2-2, the second section 2-3, the third section 2-4, the fourth section (2-5) (for the crown block 1 and the traveling block 3 installation) and the racking platform 2-6.

Figure 14:
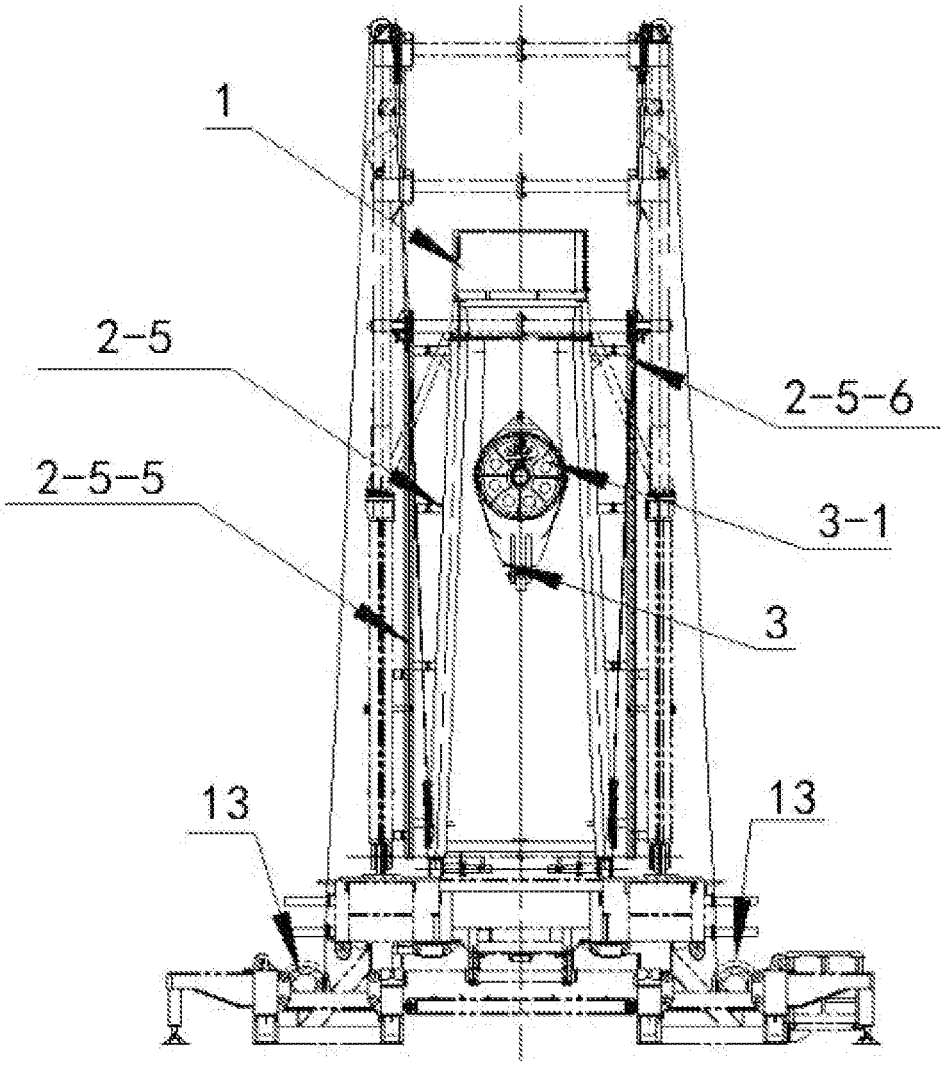
FIG. 14 is a front view of a to-be-lifted fourth section 2-5 in a base section 2-1 in FIG. 1, according to one or more embodiments.
Figure 15:
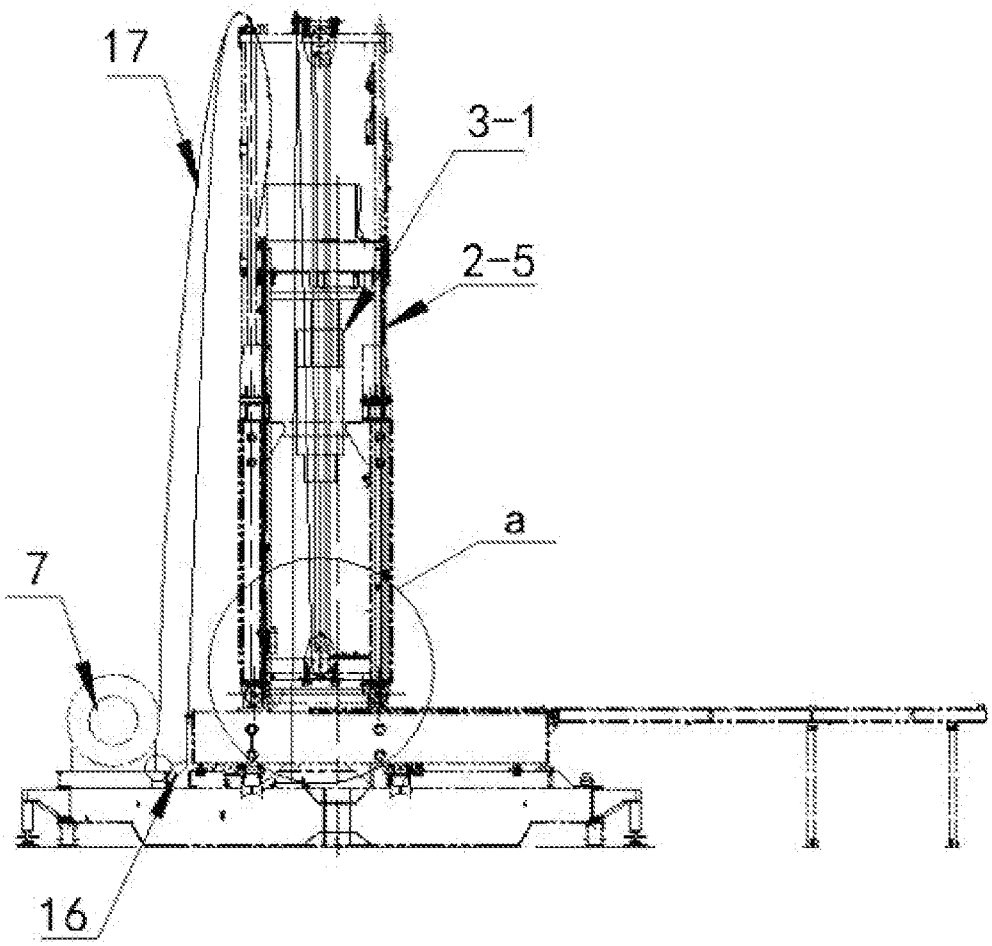
FIG. 15 is a lateral view of a to-be-lifted fourth section 2-5 in a base section 2-1 in FIG. 1, according to one or more embodiments.
Figure 16:
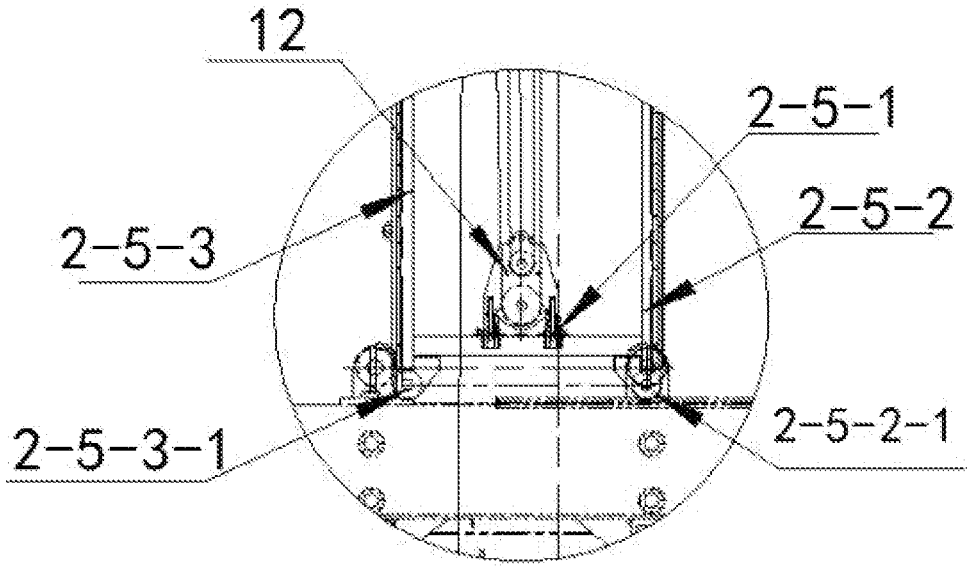
FIG. 16 is an enlarged view of a in FIG. 15, according to one or more embodiments.
Figure 17:
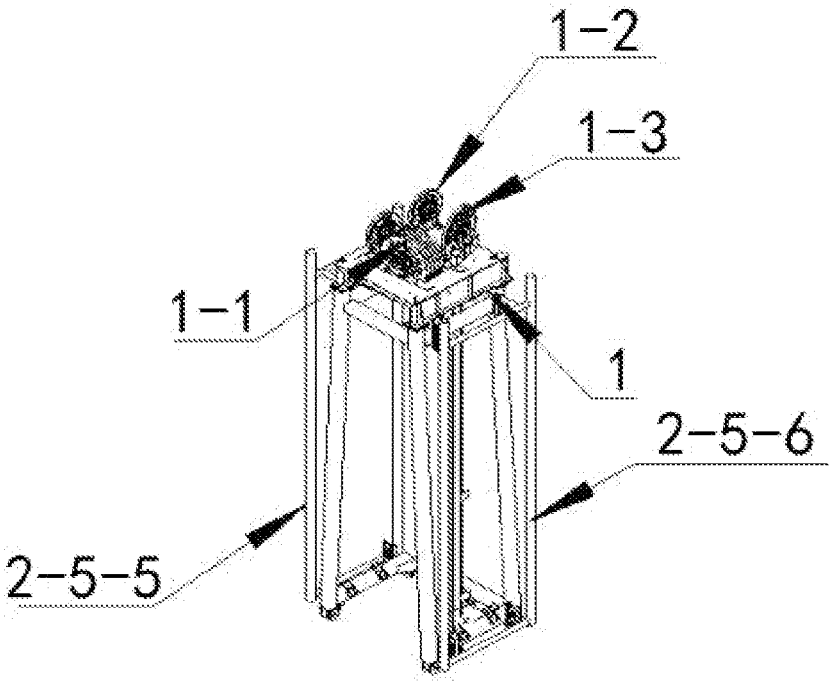
FIG. 17 is a structural view of a crown block 1 in FIG. 1, according to one or more embodiments.
Figure 18:
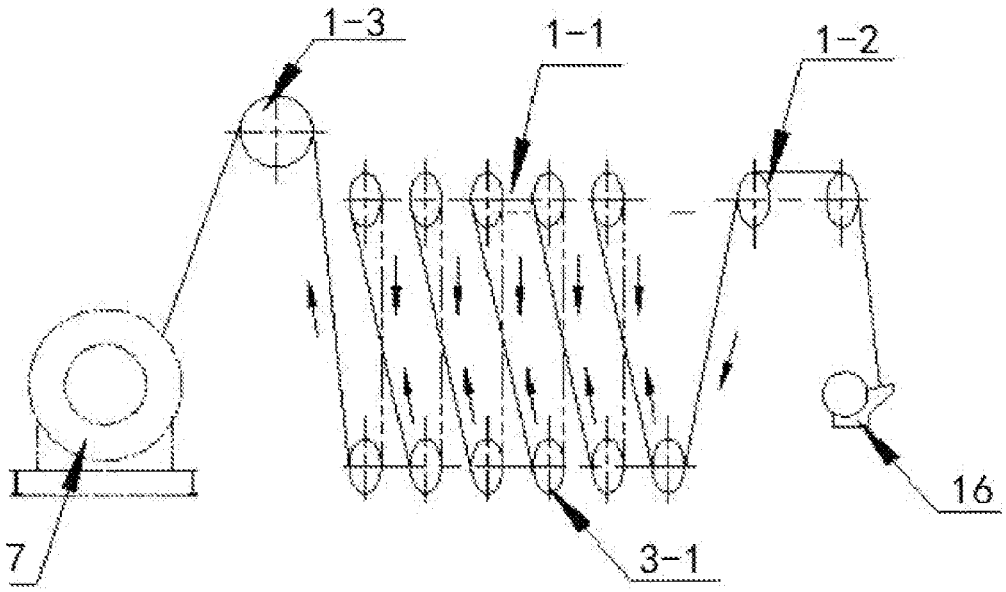
FIG. 18 is a view of a stringing of a lifting steel wire rope of an embodiment of a lift-type drilling rig of the invention, according to one or more embodiments.
Figure 19:
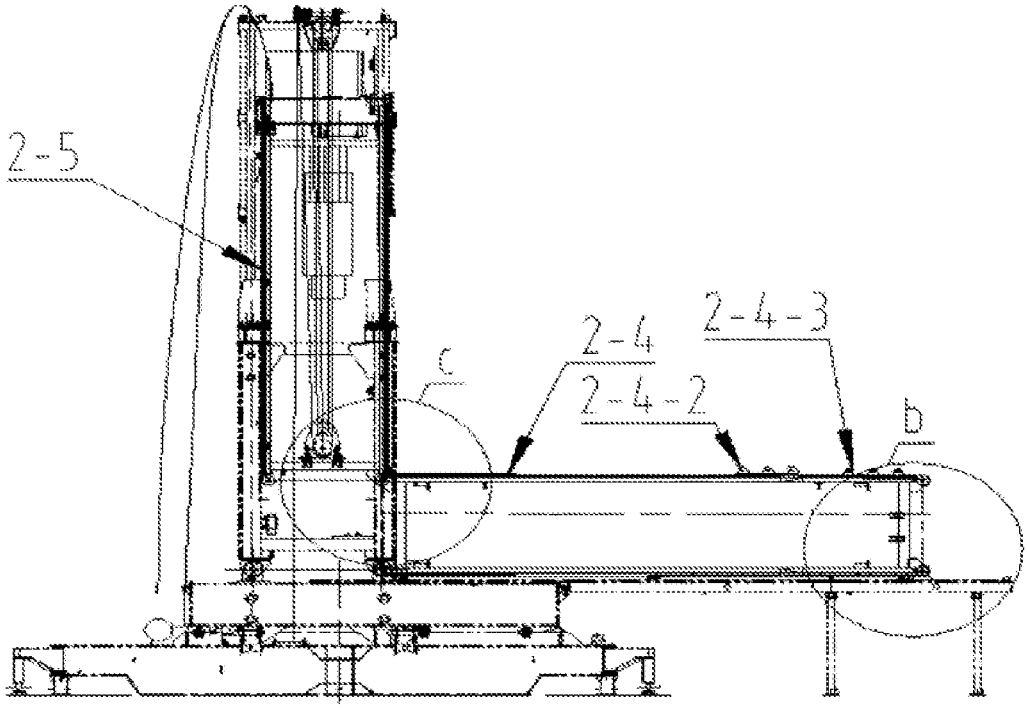
FIG. 19 is a view of a to-be-lifted third section 2-4 in FIG. 1, according to one or more embodiments.
Figure 20:
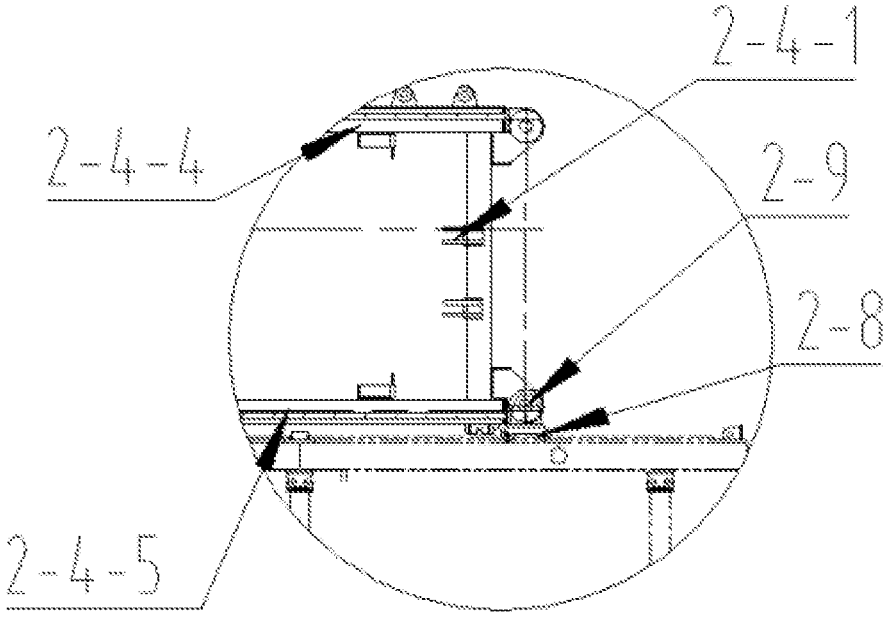
FIG. 20 is an enlarged view of b in FIG. 19, according to one or more embodiments.
Figure 21:
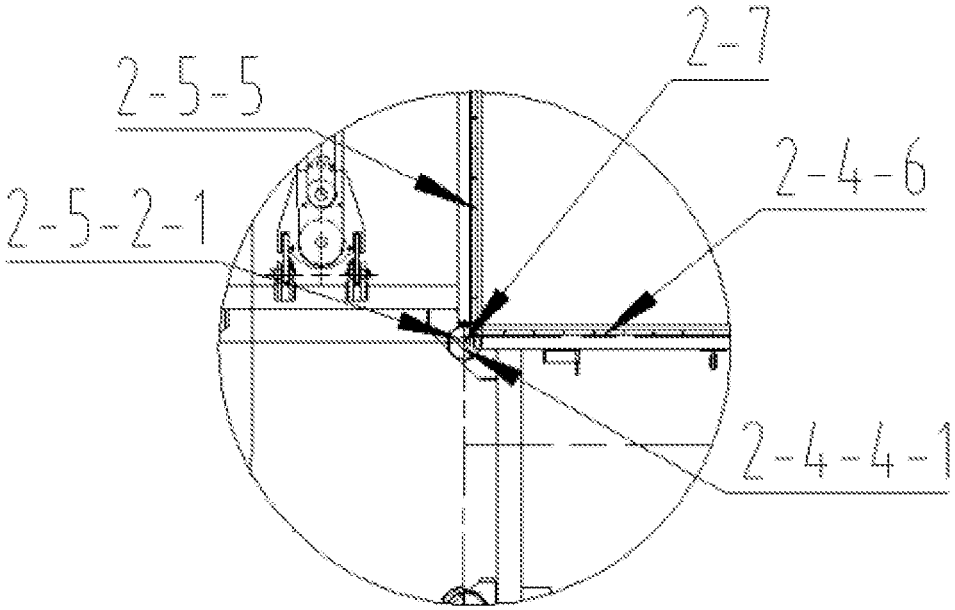
FIG. 21 is an enlarged view of c in FIG. 19, according to one or more embodiments.
Figure 22:
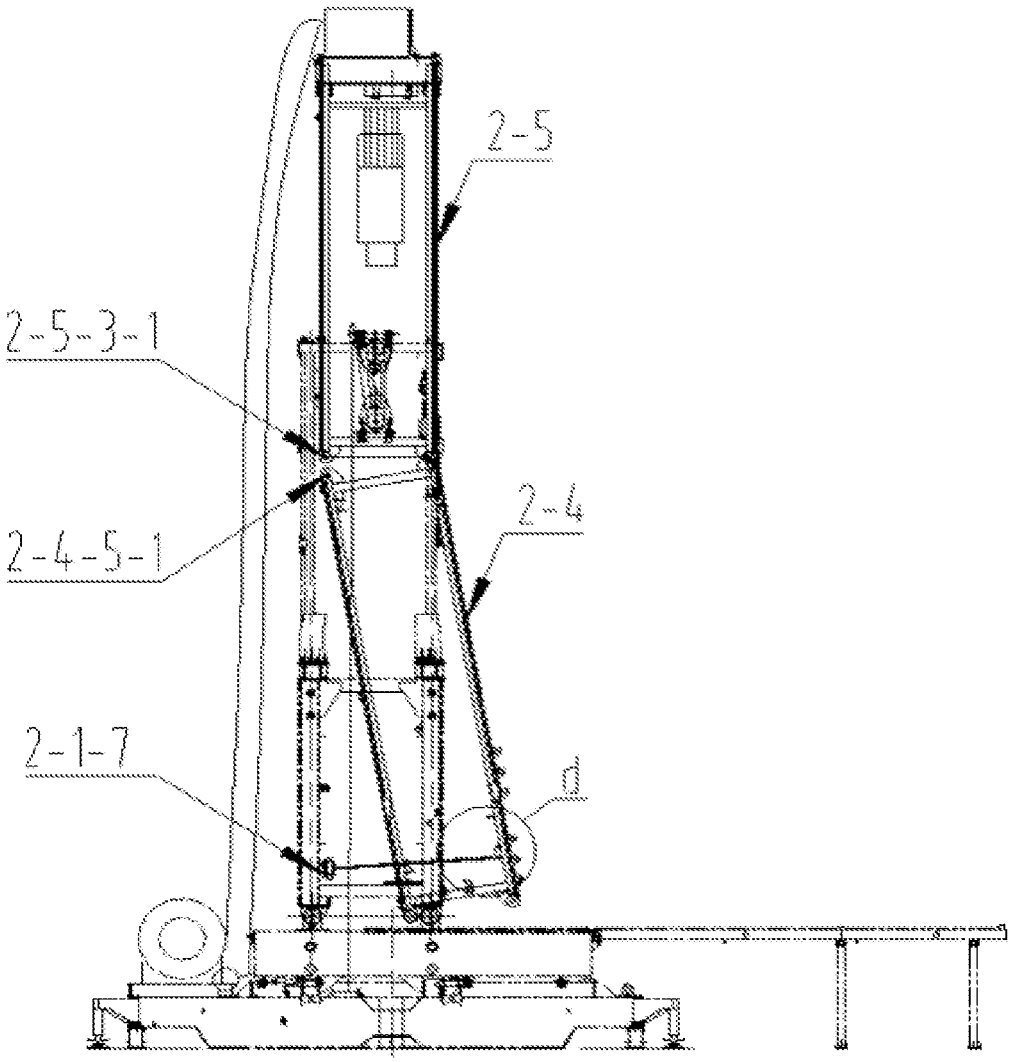
FIG. 22 is a schematic view of a lifting process of a third section 2-4 in FIG. 19.
Figure 23:
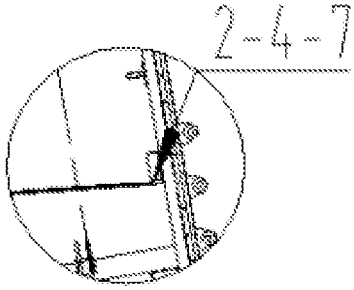
FIG. 23 is an enlarged view of d in FIG. 22, according to one or more embodiments.
Figure 24:
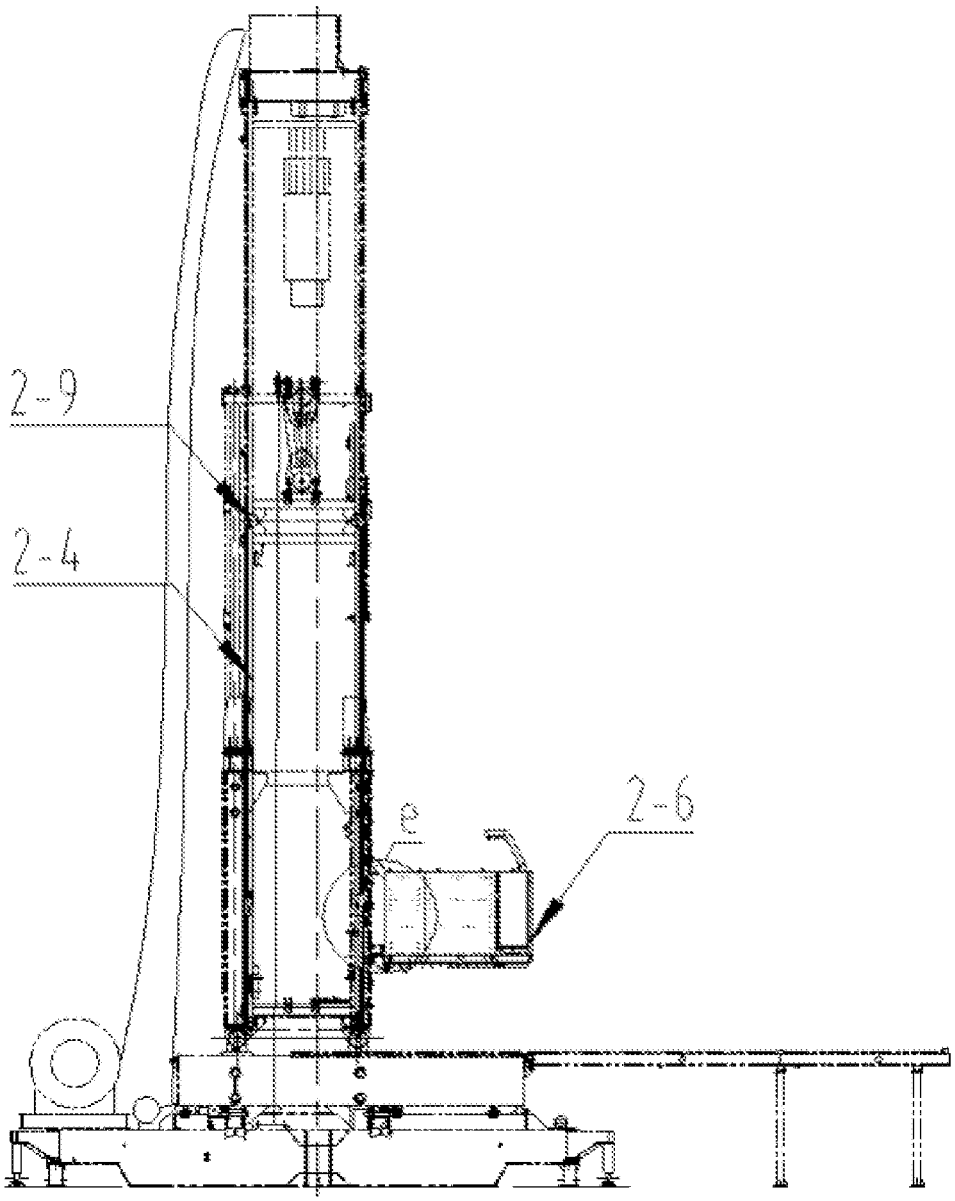
FIG. 24 is an installing view of a racking platform 2-6 in FIG. 1, according to one or more embodiments.
Figure 25:
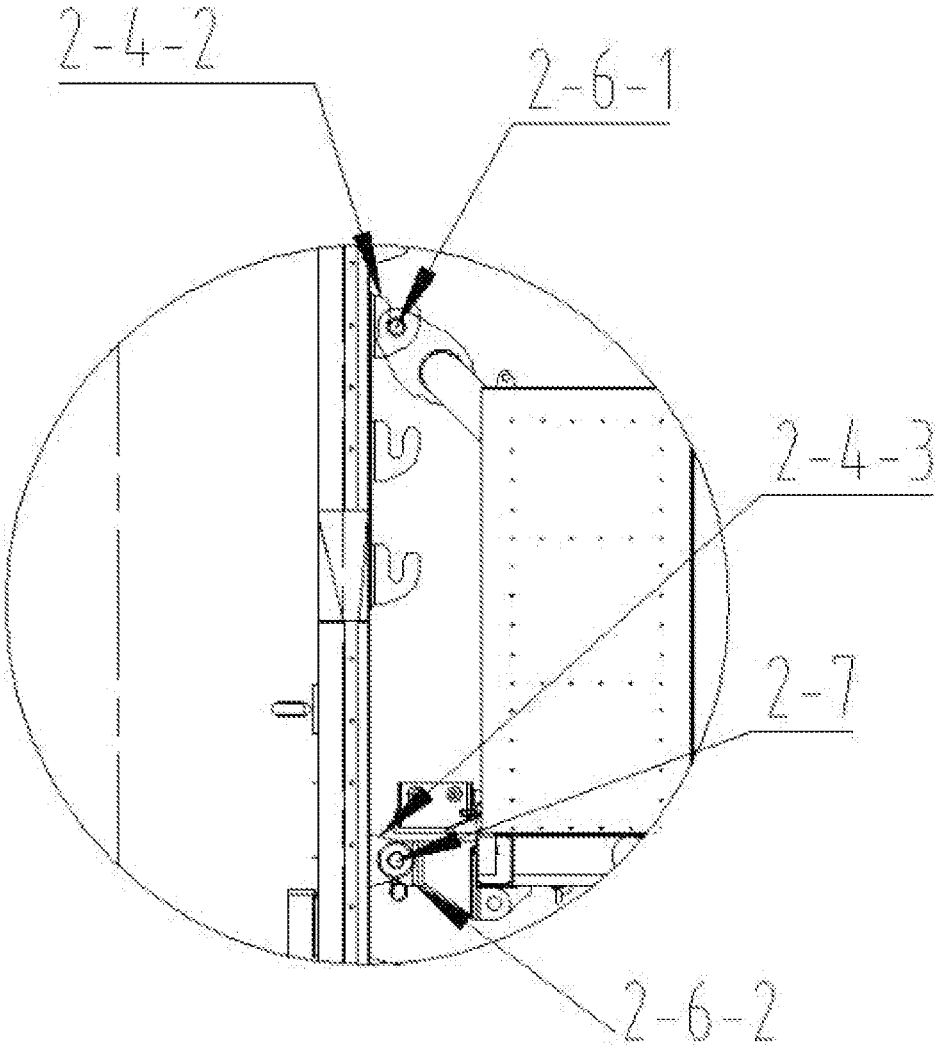
FIG. 25 is an enlarged view of e in FIG. 24, according to one or more embodiments.
Figure 26:
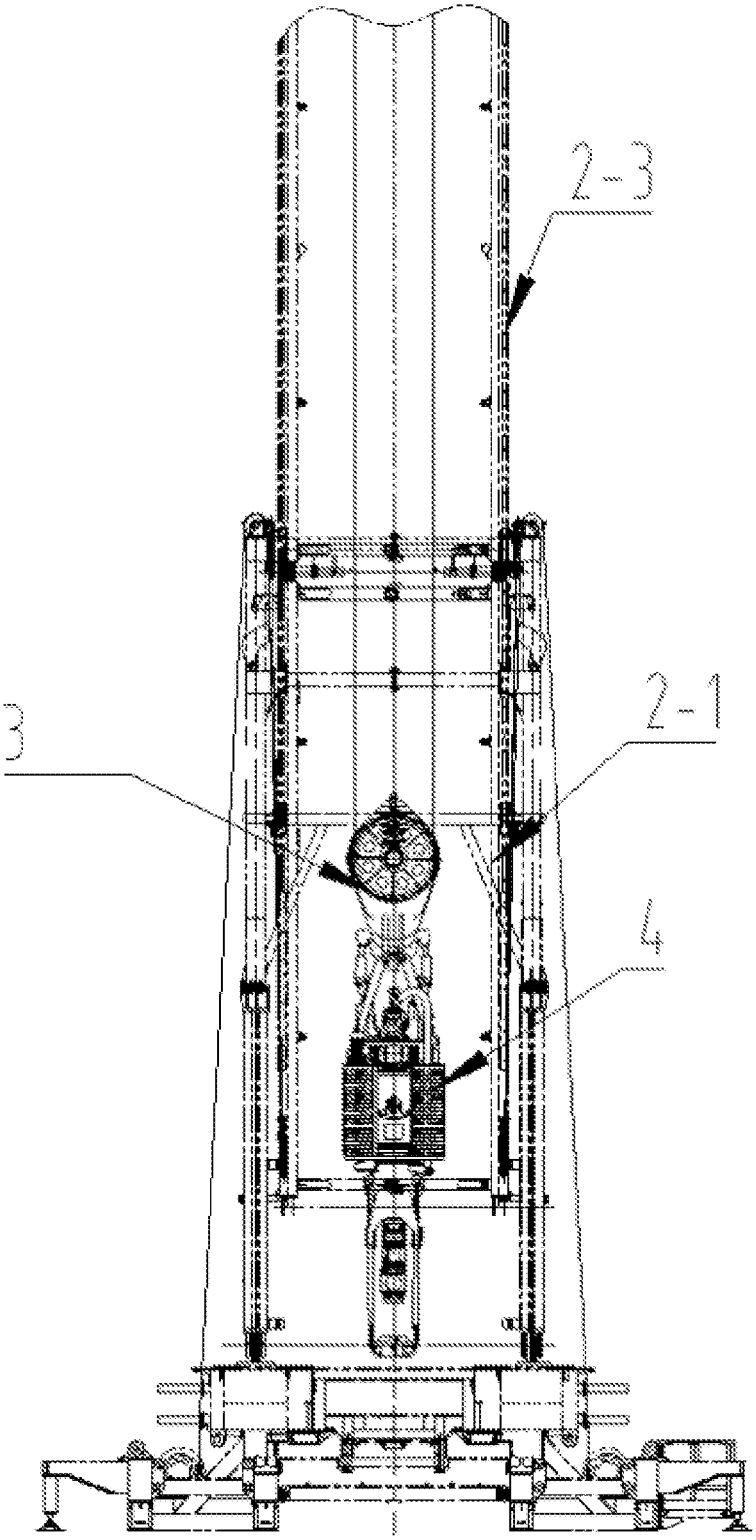
FIG. 26 is an installing view of a top drive 4 in FIG. 1, according to one or more embodiments.
Figure 27:
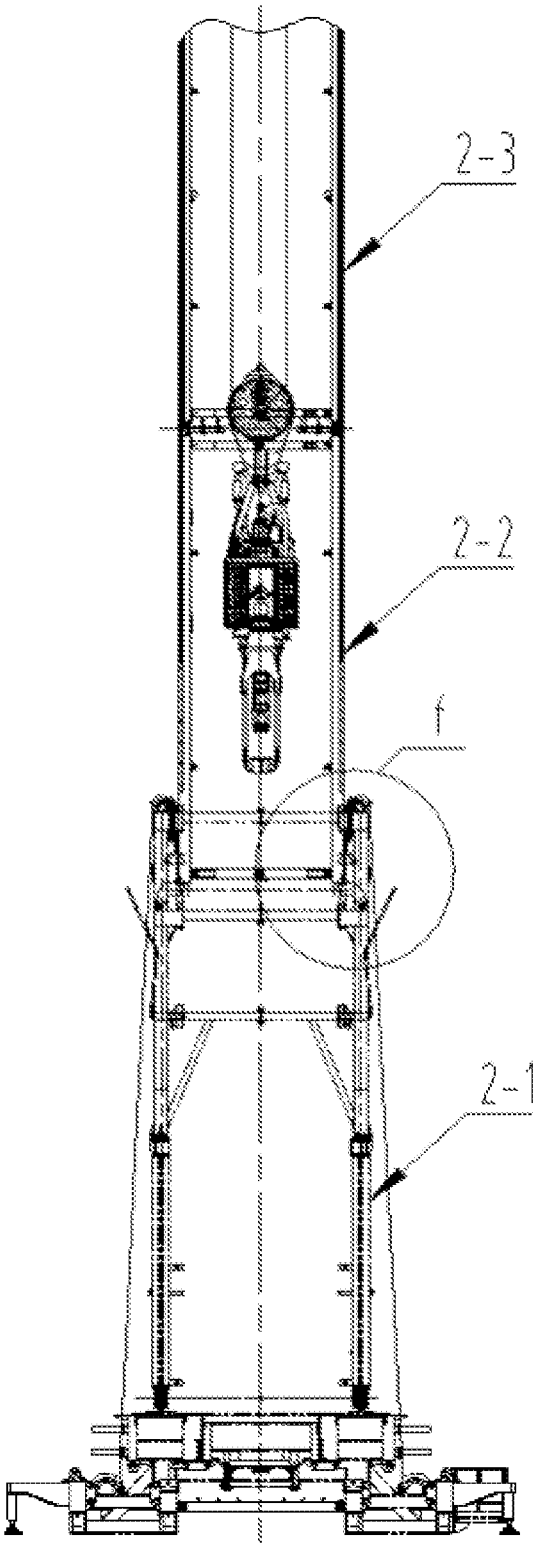
FIG. 27 is a view of a mast 2 lifted in FIG. 1, according to one or more embodiments.
Figure 28:
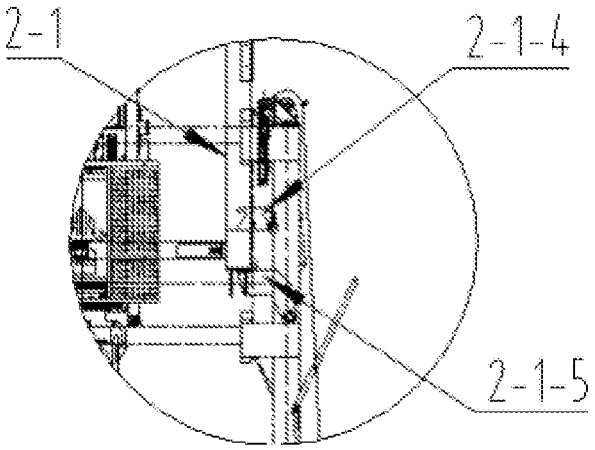
FIG. 28 is an enlarged view of f in FIG. 27, according to one or more embodiments.
Figure 29:
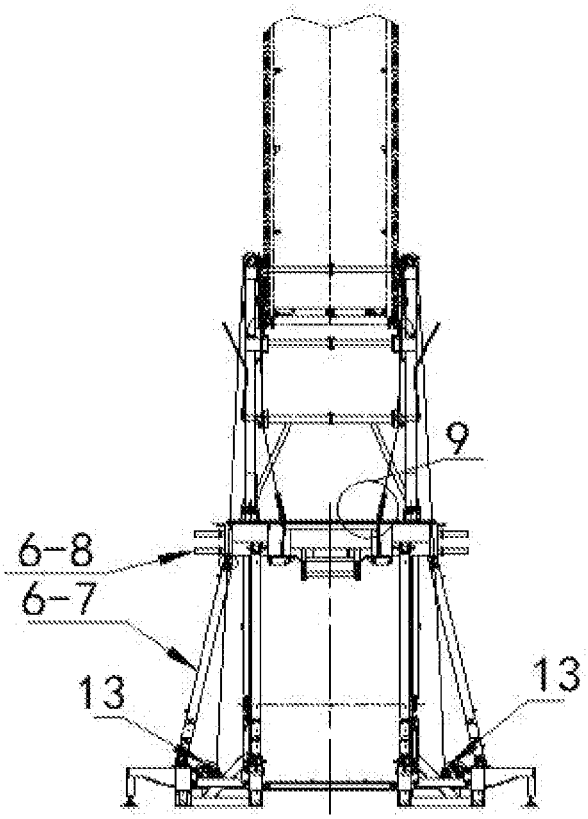
FIG. 29 is a view of a substructure 6 lifted in FIG. 1, according to one or more embodiments.
Figure 30:
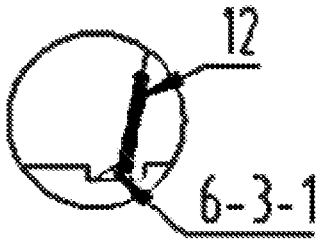
FIG. 30 is an enlarged view of g in FIG. 29, according to one or more embodiments.

Minimum size of an inner frame of the base section 2-1 is no less than a maximum size of corresponding outer frame fitted with a section for a section smoothly lifting through the base section 2-1 and for a pulley block installation for lifting. A fourth section 2-5 is contracted with bottom section larger than top section which connects to a crown block. In order to guarantee the fourth section 2-5 lifting through the base section 2-1, a fourth outer frame 2-5-6 as shown in FIG. 17 is set. In order to guarantee smooth lifting of a section, a guide rail strip 2-5-5 is set on an outer surface of pillar of a first section 2-2, a second section 2-3 and a third section 2-4 as well as the fourth outer frame 2-5-6 fitting the fourth section as shown in FIG. 14. And a guide rail strip is strip-shape made from a wear-resistant material. As shown in FIG. 16, lifting lugs connect to the middle of each of cross beams on two sides of the lower region of the fourth section. A front pillar pin hole is in a front pillar lower region of the fourth section, sometimes each of the two front pillars has a front pillar pin hole. A rear pillar pin hole is in a lower region of the rear pillar of the fourth section. Sometimes each of the two rear pillars has a rear pillar pin hole. As shown in FIG. 20, lifting lugs 2-4-1 connects to the middle of each of the cross beams on two sides of the lower region of the third section, a front pillar pin hole 2-5-2-1 is in the upper region and lower region of the front pillar, rear pillar pin hole 2-4-4-1 is in the upper region and lower region of the rear pillar, and a hook 2-4-2 and a lug plate 2-4-3 for fixing the racking platform are provided on two front pillars 2-4-4 of the third section. Lifting lugs connects to the middle of each of the cross beams on two sides of a lower region of the second section. Front pillar pin holes are in the upper region and the lower region of the front pillar of the second section, and rear pillar pin holes are in the upper region and the lower region of the rear pillar of the second section. A front pillar pin hole is in the upper region of the front pillar of the first section, and a rear pillar pin hole is in the upper region of the rear pillar of the first section.

Figure 2:
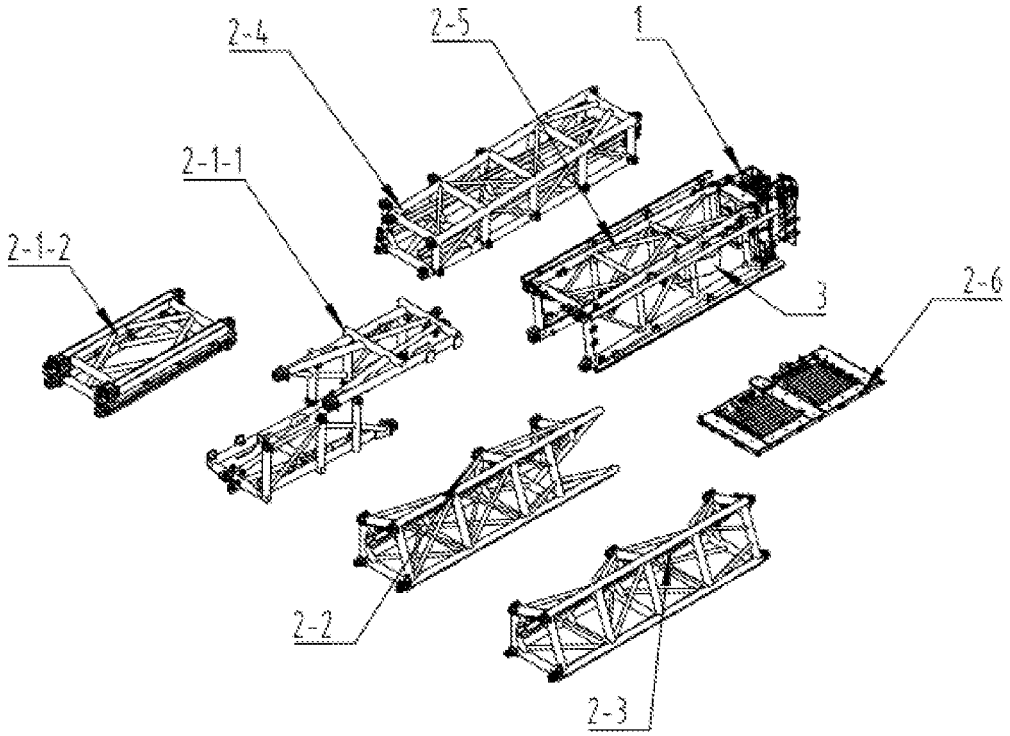
FIG. 2 is a view of a to-be-transported mast 2 in FIG. 1 in a module-divided mode, according to one or more embodiments.
Figure 3:
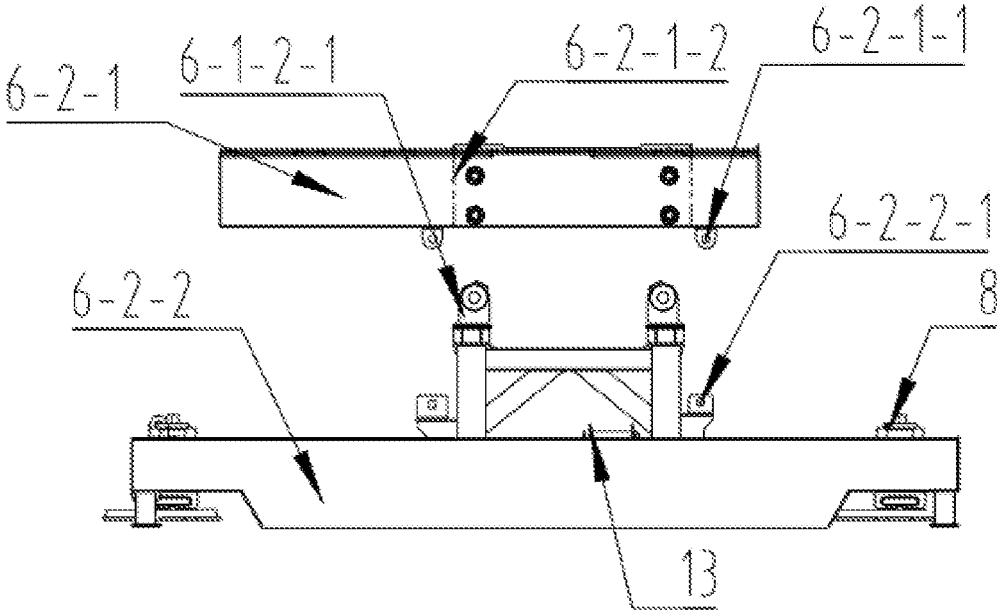
FIG. 3 is a view of a right module of a substructure 6 in FIG. 1 before installation, according to one or more embodiments.
Figure 4:
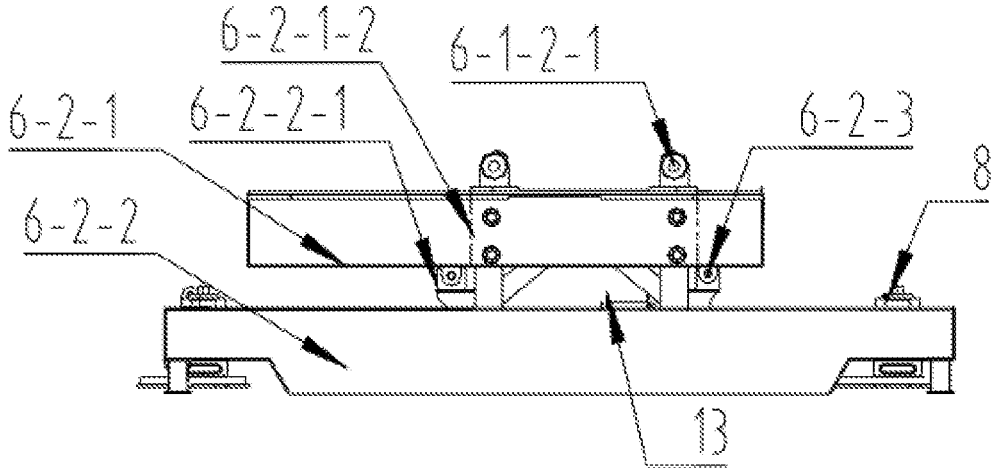
FIG. 4 is a view of a right module in FIG. 3 after installation, according to one or more embodiments.
Figure 5:
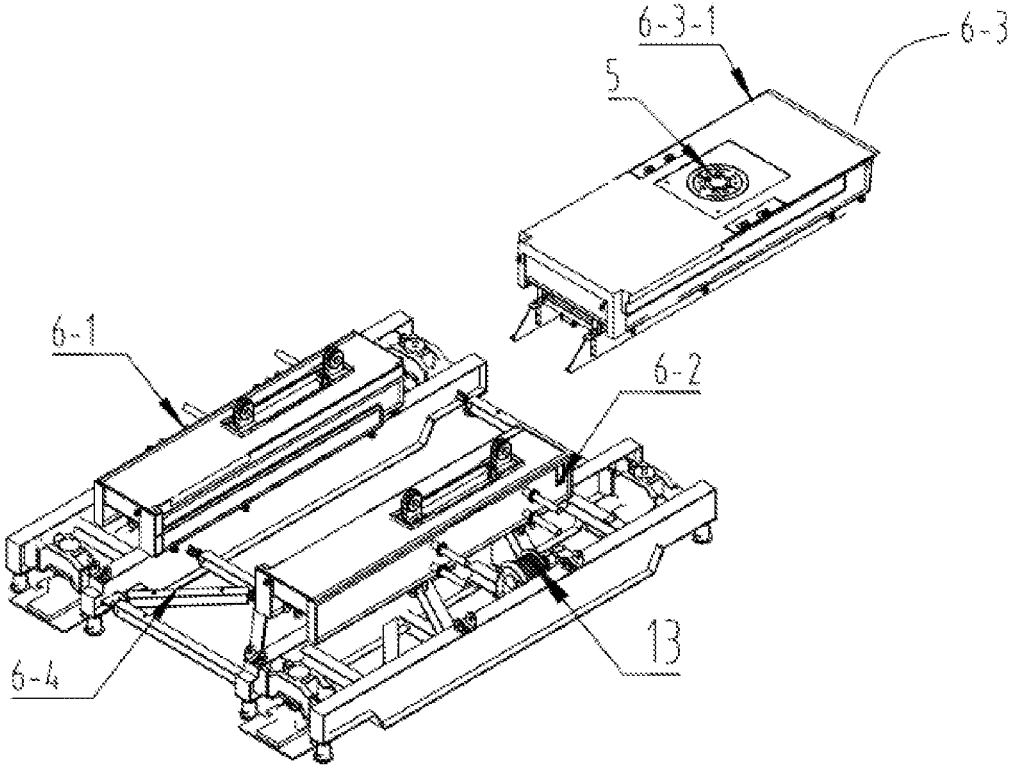
FIG. 5 is a view of a middle module as well as a left module and a right module of a substructure 6 in FIG. 1 before installation, according to one or more embodiments.

As shown in FIG. 2, a mast 2 comprises a base section 2-1, and a first section 2-2, a second section 2-3, a third section 2-4, a fourth section 2-5 (installed with a crown block 1 connecting to a traveling block 3) and a racking platform 2-6. The base section 2-1 can be divided into two modules-a base section top section 2-1-1 and a base section bottom section 2-1-2. Instead of being made of sheets, the mast 2 is made of modules. Each module is independently transported, or directly loading in a truck, or simply divided into two parts and loading, so that dismounting the module into sheets is relieved. For example, a fourth section 2-5 is loaded directly; a base section bottom section 2-1-2 is loading of being divided into two substantially parallel rectangular frame structures; a base section top section 2-1-1 is loading of being simply divided into two equal parts; a first section 2-2, a second section 2-3 and a third section 2-4 is loading directly.

Figure 31:
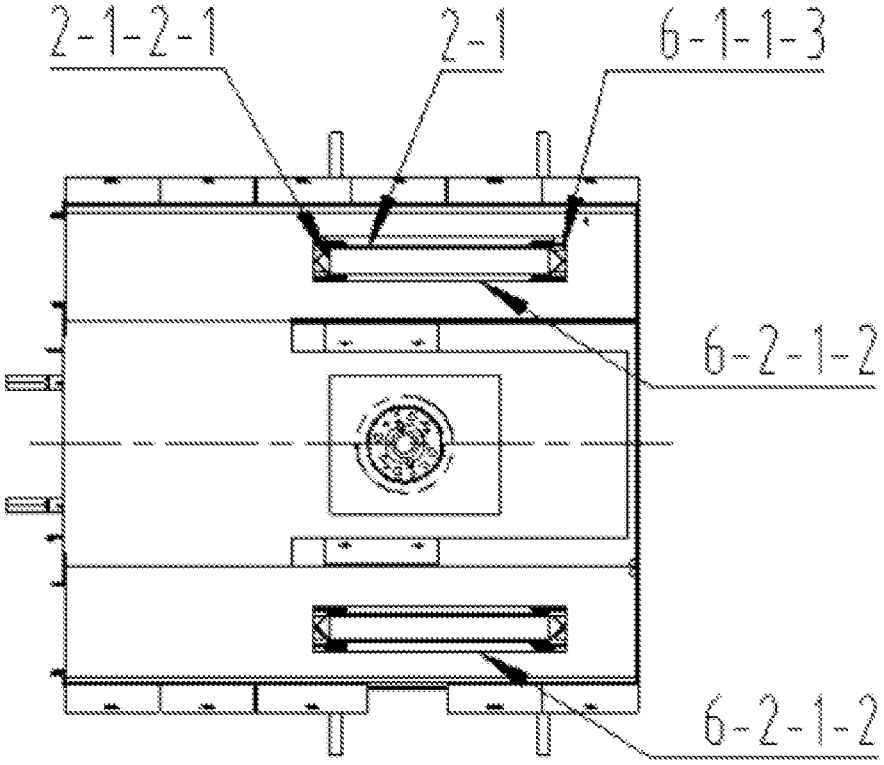
FIG. 31 is a top view of a substructure 6 in FIG. 29, according to one or more embodiments.
Figure 32:
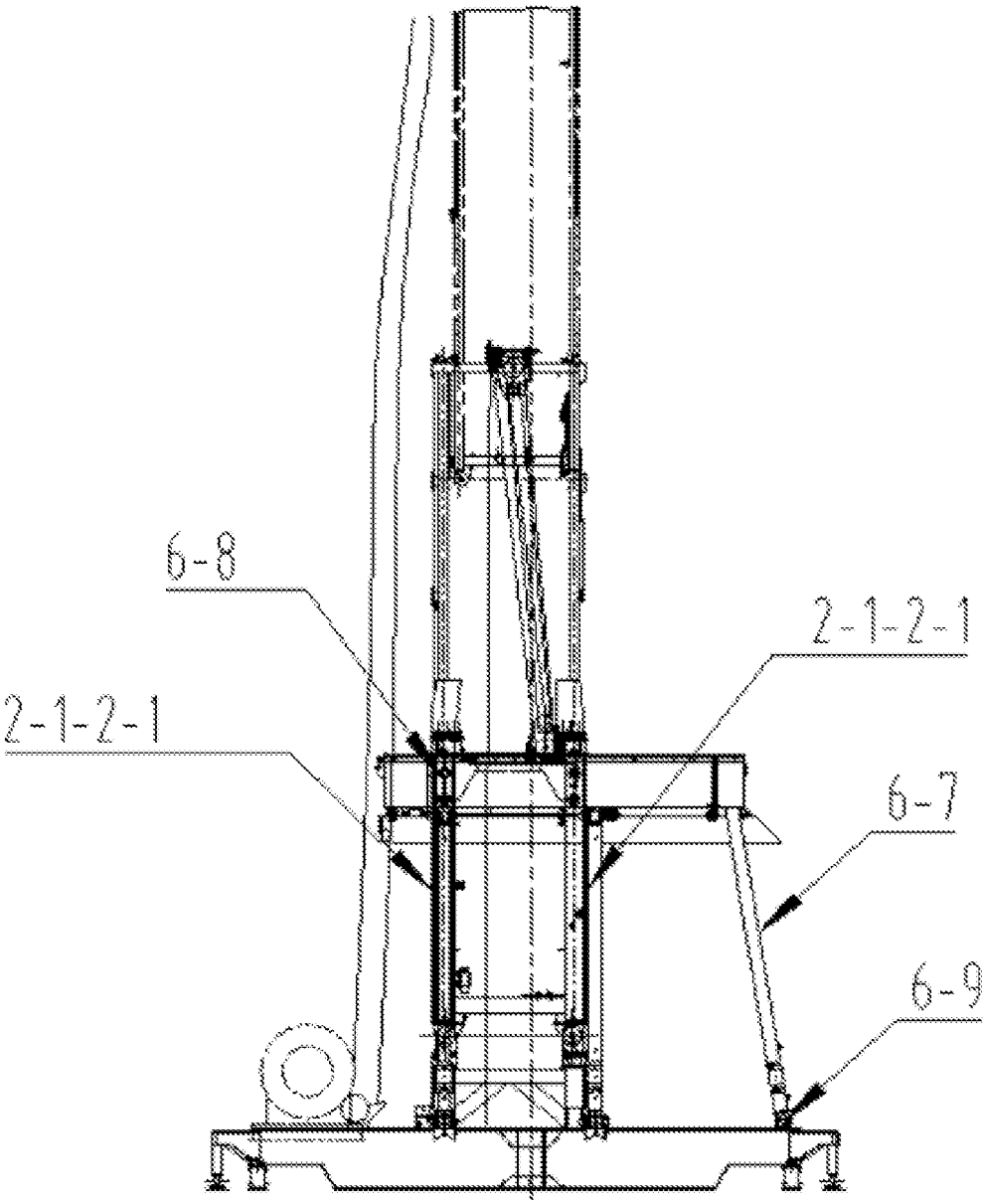
FIG. 32 is a left view of a substructure 6 in FIG. 29, according to one or more embodiments.

As shown in FIG. 3-FIG. 8 as well as FIG. 31, a substructure 6 is made of module. The substructure 6 comprises a right transportable module 6-2 and a left transportable module 6-1 as well as a middle module 6-3 (a hydraulic rotary table 5 and a middle base 6-3-1) and a pull rod 6-4. The substructure 6 which is made of separate modules is for simply installation, each module is independently transported, or directly loading in a truck or loading of being simply divided into two parts. The middle module 6-3 comprises a hydraulic rotary table 5 and a middle base 6-3-1. The left transportable module and the right transportable module are substantially the same in structure and made of being substantially symmetrical about the middle module 6-3. The right transportable module comprises a right top base 6-2-1 and a right bottom base 6-2-2 as well as a walking device 8 and a lifting hydraulic winch 13. A stop lug plate 6-2-1-1 is installed on a bottom side of the right top base 6-2-1. A stop lug base 6-2-2-1 is installed on a top side of the right bottom base 6-2-2. The stop lug plate 6-2-1-1 and the stop lug base 6-2-2-1 connect by a pin 6-2-3 to prevent the right top base from shaking up and down by the right bottom base (the pin 6-2-3 is removed before the substructure lifting) during transportation. A lifting lug 6-3-1-1 which works as a lifting point during lifting of the substructure 6 is installed on the middle base 6-3-1 of the substructure. A top base K-type 6-2-1-2 is set on the left top base and the right top base. A guide rail groove 6-1-1-3 is set on two ends of the K-type. And the guide rail groove 6-1-1-3 skids on a guide rails 2-1-2-1 of the base section 2-1 during lifting.

Figure 12:
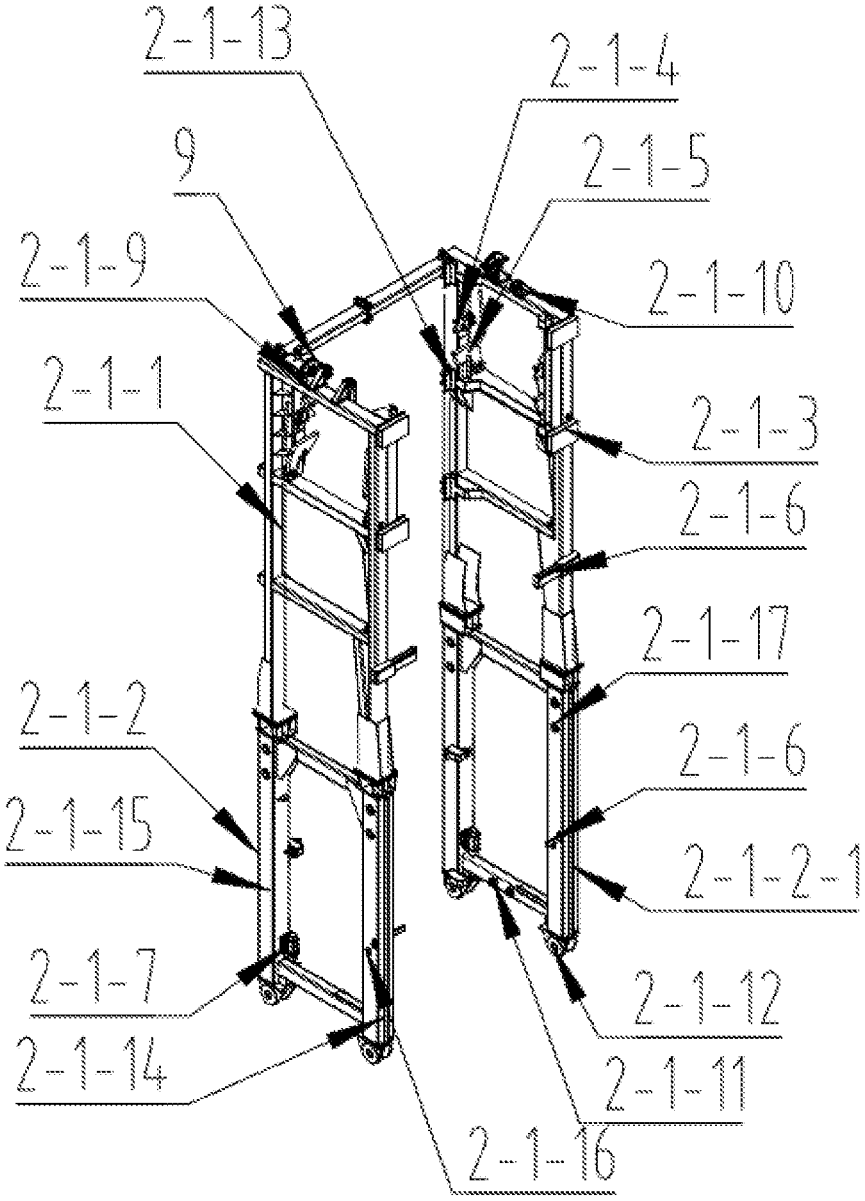
FIG. 12 is a structural view of a base section 2-1 in FIG. 1, according to one or more embodiments.

A base section 2-1 connects to a substructure and a first section which carries workload during drilling and works as a guiding during lifting. As shown in FIG. 12, the base section 2-1 connects a base section top section 2-1-1 to a base section bottom section 2-1-2 by a bolt or a pin.

Figure 6:
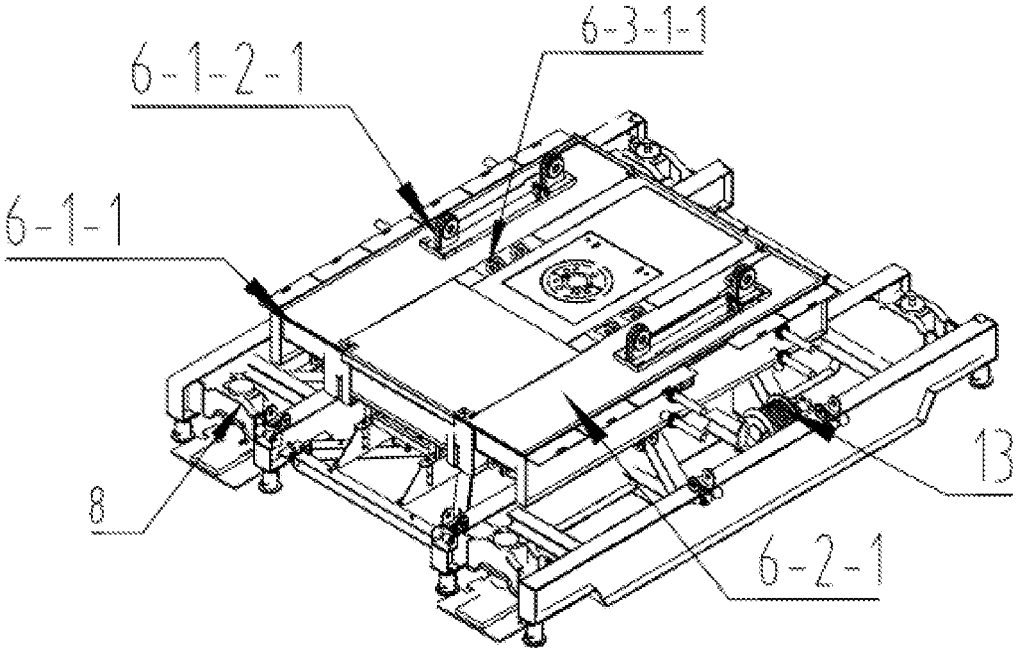
FIG. 6 is a view of a middle module as well as a left module and a right module in FIG. 5 after installation, according to one or more embodiments.
Figure 33:
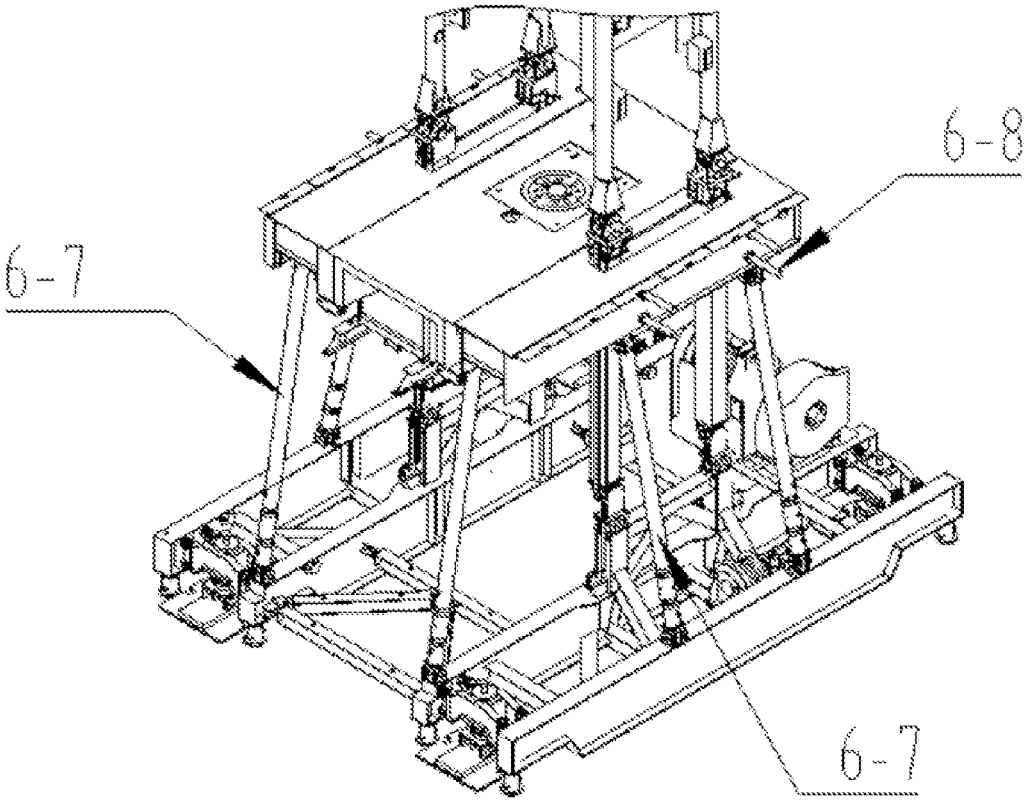
FIG. 33 is an axonometric view of a substructure 6 in FIG. 29, according to one or more embodiments.

A base section bottom section 2-1-2 is of a structure (may comprise pull rod) of two substantially parallel rectangular frames which comprises a front pillar 2-1-14, a rear pillars 2-1-15, a top cross beam (not marked) and a bottom cross beam (not marked). A pin hole 2-1-12 is in a lower region of a front pillar 2-1-14 and a rear pillar 2-1-15. A base section 2-1 connects to a mast connecting lug base 6-1-2-1 (as shown in FIG. 6) of the substructure 6 by a pin. A substructure guide rail groove 6-1-1-3 as shown in FIG. 31, skids on a guide rail 2-1-2-1 which is set on an outer surface of a front pillar 2-1-14 and a rear pillar 2-1-15 during lifting. Two hydraulic cylinder pin mounting holes 2-1-17 are in each front pillar 2-1-14 and each rear pillar 2-1-15. And after a substructure 6 lifted, a hydraulic cylinder 6-8 pin as shown in FIG. 33 is inserted into the hydraulic cylinder pin mounting hole for connecting a substructure top to the base section. Two small winches 2-1-7 are set on two rear pillars 2-1-15 to draw a first section and a second section as well a third section and a fourth section. After one section entered into an inner frame of the base section and drawn substantially vertical, a pin is conveniently driven into a rear pillar pin hole of the next section aligning with the rear pillar pin hole of the previous section. And two base section technical holes 2-1-16 are in two front pillars 2-1-14 for assisting conducting pin connection of the first section and the second section as well the third section and the fourth section entering into the inner frame of the base section.

A base section top section 2-1-1 is made of connecting two substantially symmetrical L-shaped frames (a back bar and the like are not shown).

Figure 13:
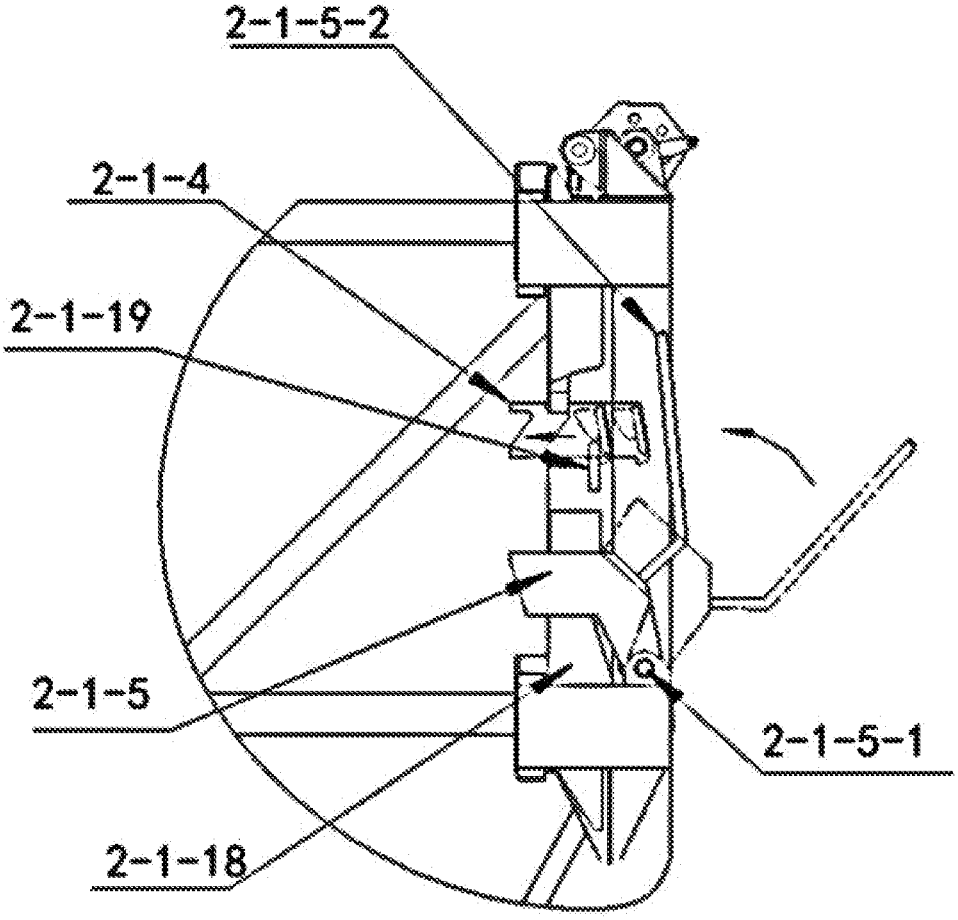
FIG. 13 is a view of working mode conversion between a clamping block assembly 2-1-4 and a supporting block assembly 2-1-5 in FIG. 12, according to one or more embodiments.

In addition, a supporting block assembly 2-1-5, sometimes the supporting block assembly number is four, is provided on a base section top section of being substantially horizontal and lateral symmetrical for supporting lifting. As shown in FIG. 13, the supporting block assembly comprises supporting block, handle 2-1-5-2 and cushion block 2-1-18. The cushion block 2-1-18 is fixed with a cross beam of the base section. The supporting block is hinged with a front pillar and a rear pillar by a hinge 2-1-5-1. By pulling the handle 2-1-5-2, the supporting block assembly rotates around the hinge 2-1-5-1 in direction marked by an arrow, and a bottom plane of the supporting block drops on a cushion block 2-1-18 located on a cross beam of the base section to support the first section and the second section as well the third section and the fourth section entering into an inner frame of the base section and to prevent the first section and the second section as well the third section and the fourth section from dropping.

In addition, a clamping block assembly 2-1-4, sometimes the clamping block assembly number is four, is set on a base section top section above a top side of the supporting block assembly 2-1-5 of being substantially horizontal and lateral symmetrical. A bottom cross beam of a first section drops to the supporting block assembly after lifted. And the clamping block assembly clamps a top surface of the bottom cross beam of the first section to prevent the section from moving. As shown in FIG. 13, two bumps are set on each clamping block assembly in direction marked by an arrow. The bumps on an outer side are substantially horizontal moved to skid into clamping block guide rail groove 2-1-19 for clamping. And in opposite direction, the bumps on the outer side are moved to skid out of the clamping block guide rail groove or the bumps on the inner side skidding into the clamping block guide rail groove 2-1-19 for releasing.

In addition, four front aligning plates 2-1-3 are fixed on two front pillars of the base section, and four back aligning plates 2-1-13 are fixed on two rear pillars of the base section. After a section lifted, guide rail strips of the section skid on the surface of the front aligning plates and the back aligning plates, and meanwhile, the front aligning plates 2-1-3 and the back aligning plates 2-1-13 are for aligning the mast and preventing the mast from getting overturn.

In addition, four movable door bolts 2-1-6 are additionally set on two front pillars of the base section. The number of base section bottom sections is two and the number of base section top sections is two. Each door bolt can be extending and retracting. The door bolt 2-1-6 extends for constraint and aligning the section together with the front aligning plate 2-1-3 after the lifted section from oblique to substantially vertical.

Figure 11:
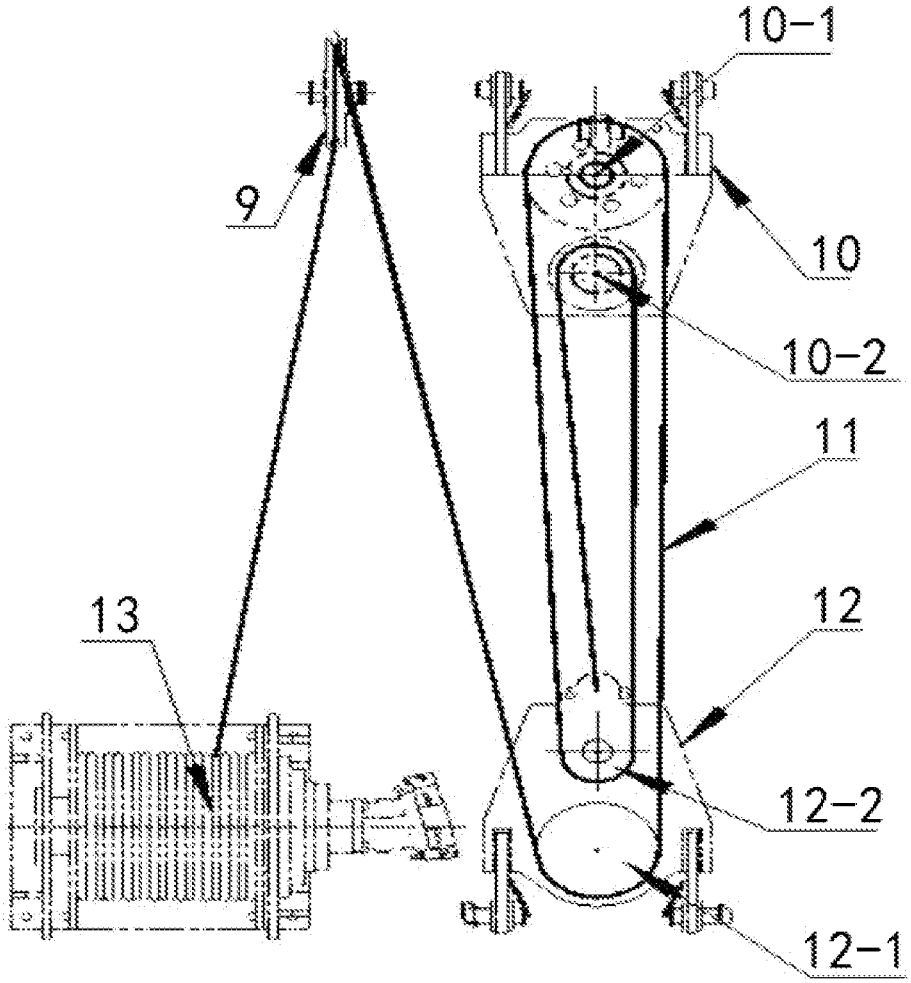
FIG. 11 is a view of a stringing of a lifting steel wire rope of an embodiment of a lift-type drilling rig of the invention, according to one or more embodiments.

As shown in FIG. 11 and FIG. 12, a fixed pulley block mounting base 2-1-10 and a guide pulley mounting base 2-1-9 are fixed on two top beams of a base section, and a movable pulley block mounting base 2-1-11 is fixed on two bottom beams of the base section. The fixed pulley block 10 which comprises big pulley 10-1 and small pulley 10-2 is installed on the fixed pulley block mounting base 2-1-10. A movable pulley block 12 which comprises big pulley 12-1 and small pulley 12-2 is installed on the pulley block mounting base 2-1-11. A guide pulley 9 is set on the guide pulley mounting base 2-1-9. A lifting steel wire rope 11, after wound from lifting hydraulic winches 13, winds around the guide pulley 9, winds around the big pulley 12-1 of the movable pulley block 12 and winds around the big pulley 10-1 of the fixed pulley block 10, and the lifting steel wire rope winds around the small pulley 12-2 of the movable pulley block 12 and the small pulley 10-2 of the fixed pulley block 10, and finally, the rope head are fixed to a top of the fixed pulley block 12.

Figure 10:
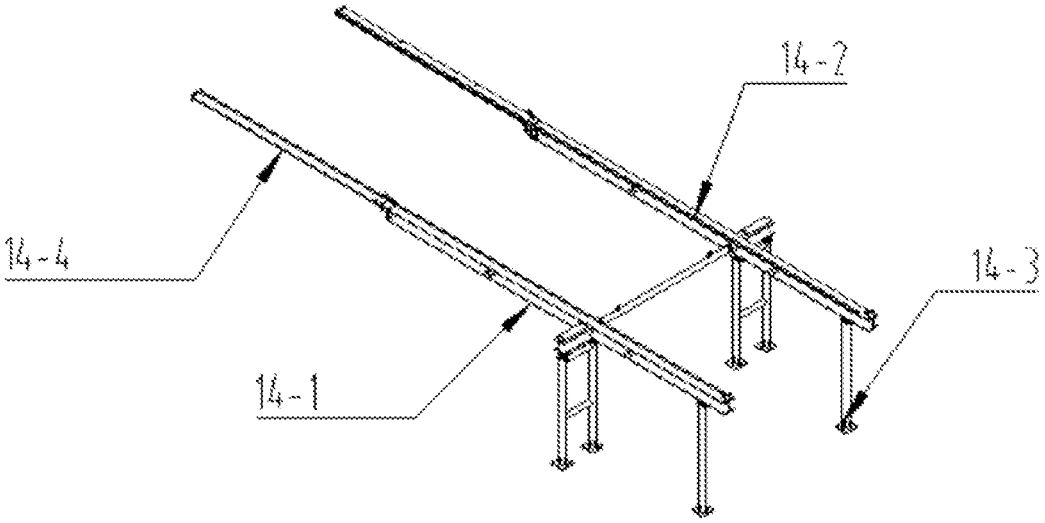
FIG. 10 is a structural view of a mast mounting rack 14 in FIG. 9, according to one or more embodiments.

A mast mounting rack 14 supports installation as shown in FIG. 10. The mast mounting rack 14 comprises a rack body 14-1, a guide rail 14-2, a supporting leg 14-3 and a platform guide rail 14-4. Wherein, the platform guide rail 14-4 is set on a surface of a middle base of a substructure as an extension of the guide rail 14-2 if needed. Pulley 2-8, as shown in FIG. 20, is installed with a rear pillar pin hole for the third section, the second section and the first section lifting, and the pulley 2-8 skids on the guide rail 14-2 and the platform guide rail 14-4.

As shown in FIG. 5-FIG. 13, a substructure and a base section are installed as below:

First, drawing a borehole centre line on site, setting a left transportable module 6-1 and a right transportable module 6-2 in place, and connecting the left transportable module 6-1 to the right transportable module 6-2 by a pull rod 6-4, lifting a middle module 6-3 between a left top base 6-1-1 and a right top base 6-2-1, and connecting the middle module 6-3 to the left top base 6-1-1 and the right top base 6-2-1, and connecting the left top base 6-1-1 and the right top base 6-2-1 to a top connecting lug plate 6-6 by pin 6-5, and setting a mast mounting rack 14.

Connecting a base section top sections 2-1-1 to a base section bottom section 2-1-2 by bolt and lifting the base section top sections 2-1-1 and the base section bottom sections 2-1-2 on a mast mounting rack 14, with a door (an opening arranged between the two front pillars 2-1-14) downwards, aligning a pin hole 2-1-12 in a bottom side of a front pillar with mast connecting lug base 6-1-2-1 on a front side of a left bottom base and a right bottom base, and driving a pin 16 into the pin hole, installing a fixed pulley block 10 on a fixed pulley block mounting base 2-1-10 of the base section, installing a movable pulley block 12 on a movable pulley block mounting base 2-1-11 of the base section, installing a guide pulley 9 on a guide pulley mounting base 2-1-9, and stringing a lifting steel wire rope with one end of the rope head being fixed with a lifting hydraulic winch 13 and the other end of the rope head being fixed with a top of the movable pulley block 12, lifting a top of the base section by a crane, so that the base section rotates around a pin hole in the mast connecting lug base 6-1-2-1 to a substantially vertical mode, aligning a pin hole in a bottom side of a rear pillar with the mast connecting lug base 6-1-2-1 on a back of the left bottom base and the right bottom base, and driving pin 15 into the pin hole, so that the substructure and the base section are installed.

During the base section installation, the lifting steel wire rope is free, which is more convenient for winding operation as the base section 2-1 substantially horizontal set on the mast mounting rack 14.

As shown in FIG. 14-FIG. 28, a first section and a second section as well a third section and a fourth section are installed as below:

Detecting and guaranteeing that a clamping block assembly 2-1-4 is free, a supporting block assembly 2-1-5 is free and a movable door bolt 2-1-6 is retracted.

Substantially vertical lifting the fourth section 2-5 to a front side of a door of the base section by a crane, slowly pushing the fourth section into the base section, and making the movable door bolt 2-1-6 extending out to locate the fourth outer frame 2-5-6 of the fourth section, winding a drilling steel wire rope 17, specifically, the rope 17 from a dead line fixture 16 and winding a dead line pulley 1-2 on a crown block 1 and a traveling block pulley 3-1 and then winding the traveling block pulley 3-1 and a crown block main pulley 1-1 and finally winding a fast line pulley 1-3 of the crown block and with the rope head connecting a direct driving winch 7, wherein the steel wire rope 7 length between a dead line fixture 16 and the dead line pulley 1-2 as well as between a fast line pulley 1-3 and a direct driving winch 7 is about 40 m for lifting the sections except for the base section, Dismounting a movable pulley block 12 from a movable pulley block mounting base 2-1-11 of the base section, connecting the movable pulley block 12 to a lifting lug 2-5-1 of the lower region of the fourth section.

Lifting the third section 2-4 with door upward and substantially horizontal setting the third section 2-4 on the mast mounting rack 14, connecting a pulley 2-8 with a rear pillar pin hole in the lower region of a rear pillar 2-4-5 by a pin 2-9, starting the lifting hydraulic winches 13, wherein the fourth section 2-5 skids on a surfaces of a front aligning plate 2-1-3 and a back aligning plate 2-1-13 along a guide rail strip 2-5-5, stopping the lifting hydraulic winches after a front pillar pin hole 2-5-2-1 in a lower region of the fourth section aligned to a base section technical hole 2-1-16, and aligning a front pillar pin hole 2-4-4-1 in an upper region of the third section 2-4 with a front pillar pin hole 2-5-2-1 in the lower region of the fourth section, and inserting a pin 2-7 into the pin hole.

After the movable door bolt 2-1-6 of the base section retracted, starting lifting a hydraulic winches 13, lifting the fourth section 2-5 and the third section 2-4, adjusting a supporting block assembly on the base section to a supporting mode after the third section 2-4 free hung, and rollback the lifting hydraulic winches 13 and descending the fourth section 2-5 on the supporting block assembly 2-1-5, dismounting the pulley 2-8 from the pin hole of rear pillars 2-4-5 of the third section, pulling the third section to a substantially vertical mode around drawing points 2-4-7 by two small winches 2-1-7 on the base section, aligning the rear pillar pin hole 2-4-5-1 in an upper region of the third section with a rear pillar pin hole 2-5-3-1 in a lower region of the fourth section, and driving the pin 2-9 into the pin hole, and making the movable door bolt 2-1-6 of the base section extending out to constraint an outer frame of the third section and the fourth section, removing a movable pulley block 12 from the lifting lug 2-5-1 on the lower region of the fourth section, driving the lifting hydraulic winches 13 for descending the movable pulley block, and installing the movable pulley block on the lifting lug 2-4-1 on the lower region of the third section.

Substantially horizontal moving a racking platform by a crane, hooking a hanging pin 2-6-1 which is for the racking platform top side on hook 2-4-2 of the third section, aligning lug plate 2-6-2 on the lower region of the racking platform with pin hole of lug plate 2-4-3 of the third section, and driving a pin 2-7 thereinto.

Lifting operation for the second section 2-3 is substantially the same as above mentioned.

Lifting operation for the first section 2-2 is substantially the same as above mentioned, and an upper region of the first section 2-2 is set onto the supporting block assembly 2-1-5.

Lifting the top drive 4 above the top side of the substructure, aligning the top drive center with the borehole center, descending the traveling block 3 to the first section 2-2 by the direct driving winch 7, and stop the direct driving winch 7, and connecting the traveling block 3 to the top drive.

Starting the direct driving winch 7 to lift the traveling block 3 and the top drive 4; starting the lifting hydraulic winches 13 to continue to lift the first section and placing the lower region of the first section on the supporting block assembly 2-1-5; adjusting the clamping block assembly 2-1-4, and enabling the clamping block assembly to clamp a top surface of the bottom cross beam of the first section, so that the mast is lifted.

Figure 7:
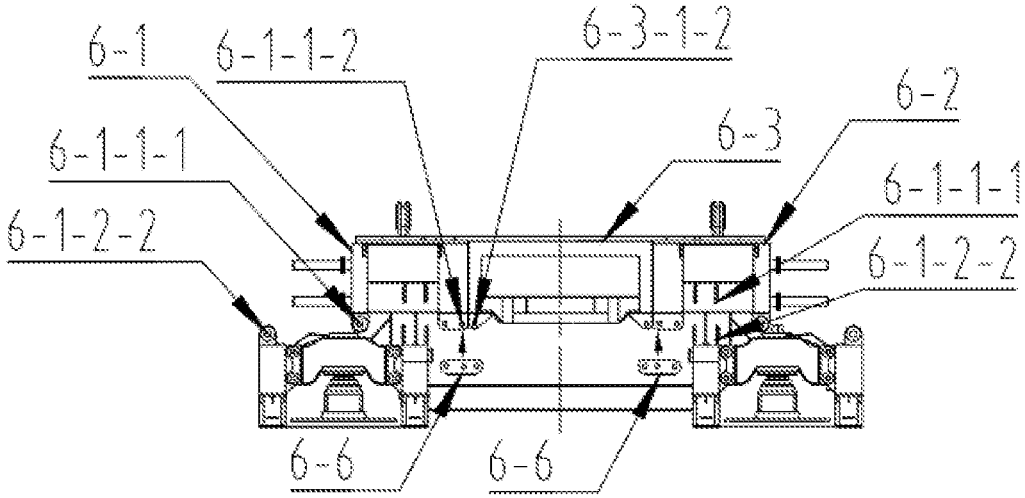
FIG. 7 is a view of a middle module as well as a left module and a right module in FIG. 6 before fixed connection, according to one or more embodiments.
Figure 8:
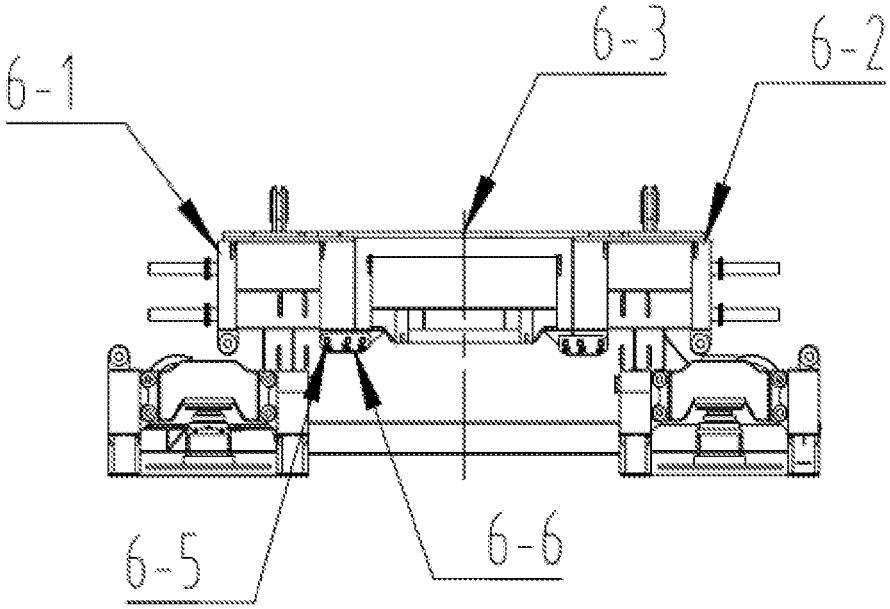
FIG. 8 is a structural view of a middle module as well as a left module and a right module in FIG. 7 after fixed connection, according to one or more embodiments.
Figure 9:
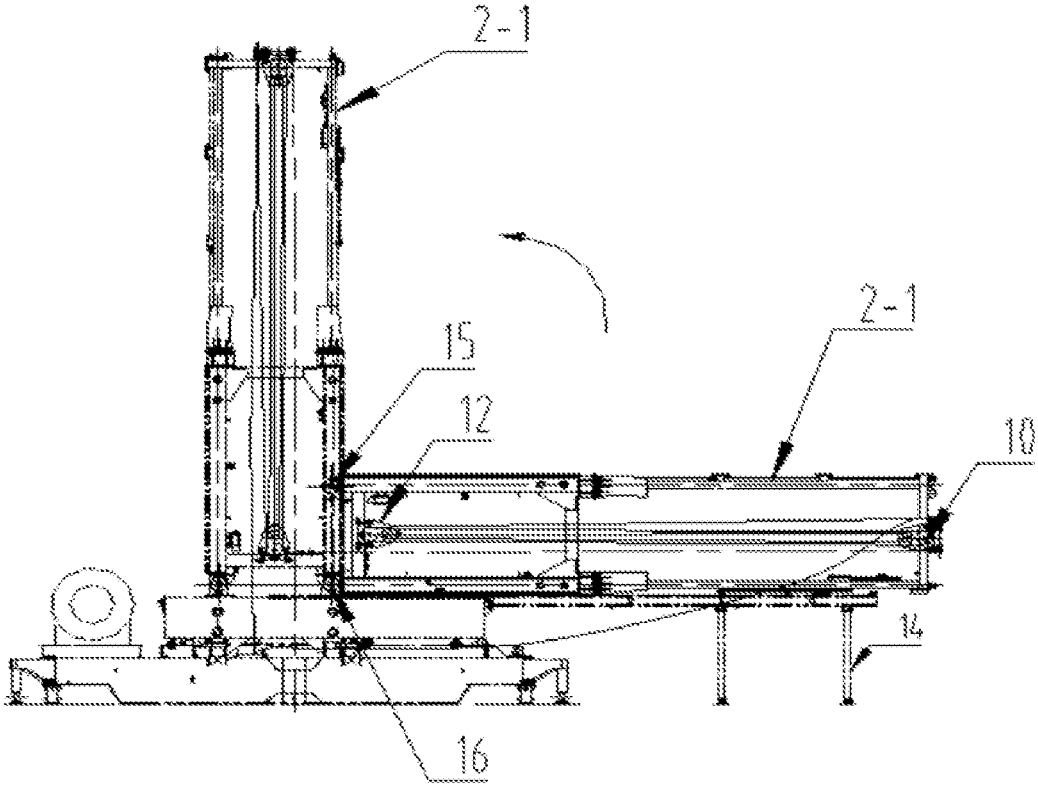
FIG. 9 is a lifting view of a base section 2-1 in FIG. 1, according to one or more embodiments.

As shown in FIG. 29-FIG. 33, the substructure is lifted as below:

Dismounting a mounting rack, connecting an oblique rod 6-7 to an oblique rod lug base 6-1-1-1 as shown in FIG. 7 of a left top base and a right top base, and six oblique rods setting on a left and a right side and a front side of the substructure; dismounting a movable pulley block 12 from a lifting lug of a first section 2-2 and connecting the movable pulley block 12 to a substructure lifting lug 6-3-1-1 as shown in FIG. 6 of a middle base; starting a lifting hydraulic winch 13, so that a substructure top comprising a left top base 6-1-1 and a right top base 6-2-1 as well as a middle module 6-3 skidding upwards along a guide rail 2-1-2-1 of a base section under the guidance of four guide rail grooves 6-1-1-3 of the left top base 6-1-1 and the right top base 6-2-1; after the substructure top in place, inserting eight pin shaft cylinders 6-8 into pin shaft cylinder mounting holes 2-1-17 in the base section so as to connect the substructure top to the base section; installing pin 6-9 in the hole after aligned a lug base hole in the oblique rod 6-7 with the oblique rod lug base 6-1-2-2 as shown in FIG. 7 of a left bottom base and a right bottom base; dismounting the movable pulley block 12 on the substructure lifting lug 6-3-1-1 and a fixed pulley block 10 on the top of the base section; starting lifting the hydraulic winches 13 and winding back the lifting steel wire rope 11, the substructure is lifted.

Figure 34:
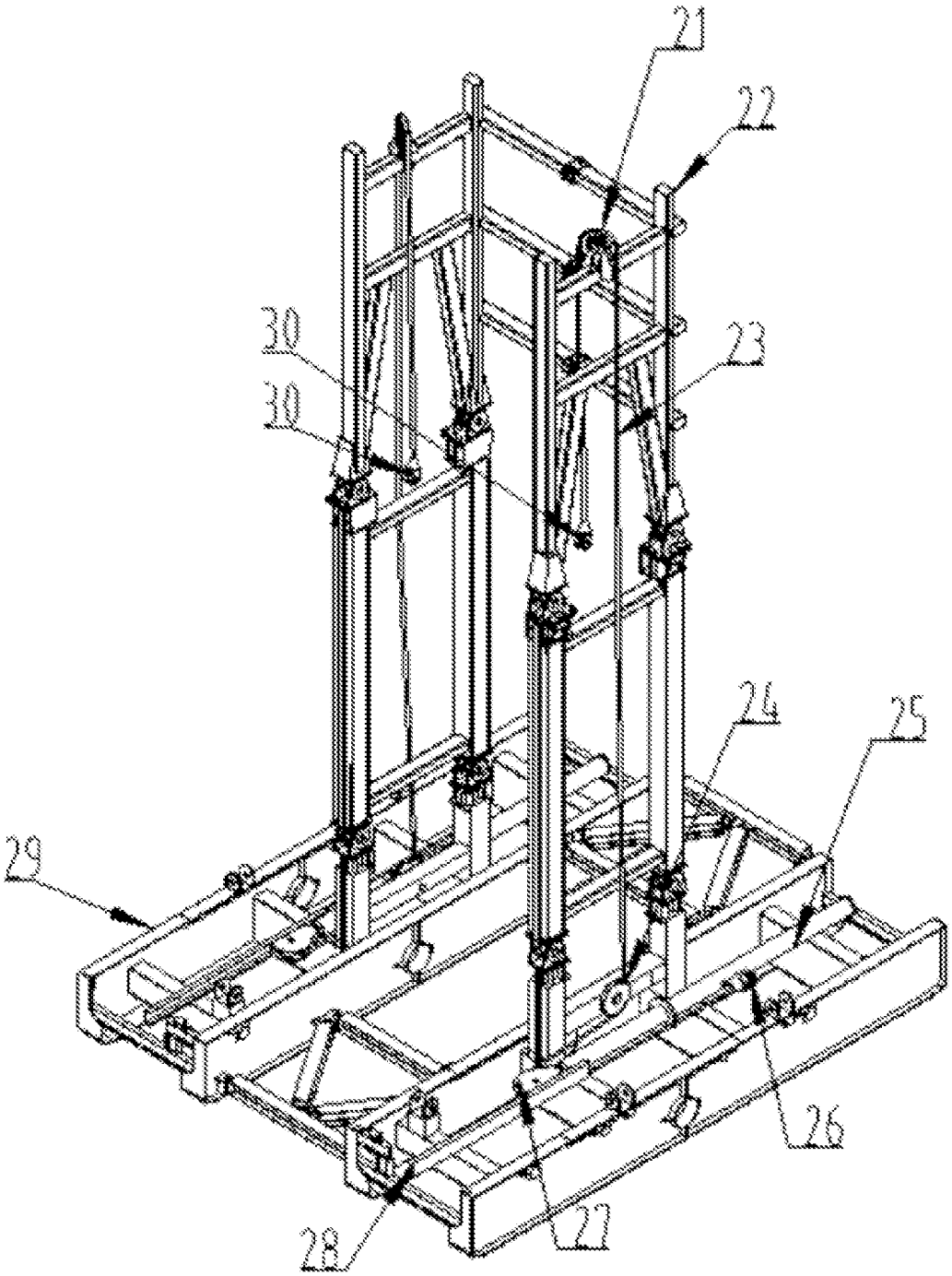
FIG. 34 is a view of a stringing of a lifting steel wire rope of another embodiment of a lift-type drilling rig of the invention, according to one or more embodiments.

As shown in FIG. 34, instead of lifting by the hydraulic winches 13 mentioned above, the sections can be lifted by a hydraulic cylinder. Two lifting hydraulic cylinders 25 are substantially horizontal and symmetrical installed on each side of a substructure bottom 29—a part except for a substructure top. A steel wire rope head I 26 of lifting steel wire rope 23 connects to the hydraulic cylinder 25 and winds around a guide pulley 27 on a piston rod of the hydraulic cylinder 25 and a guide pulley 24 on a cross beam as well as a guide pulley 21 on the base section. A steel wire rope head II 30 drops on an inner side of the base section and is fixed to a lifting lug of the section and the substructure. The piston rod of the hydraulic cylinder 25 moves on a hydraulic cylinder guide rail, so the steel wire rope head is forward or backward, and therefore, the sections and substructure are lifted.

Dismounting the drilling rig sections and the substructure is substantially reversing to lifting process. This is convenient and rapid for installation, and moreover, it is easier for well site installation and reduces space. In addition, the rig needs fewer trucks and reduces transportation workload and reduces cost effectively.

The rotary table is integrated with a hydraulic motor for size reduction. The traveling block and the top drive are lifted by the direct driven winch to improve efficiency and reduce downtime. A walking device which is integrated in a left and a right transportable module of the substructure relieves dismounting during walking in multi-direction and in-situ rotation.

As used herein, the terms "substantially" or "generally" refer to the complete or nearly complete extent or degree of an action, characteristic, property, state, structure, item, or results. For example, an object that is "substantially" or "generally" enclosed or nearly enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equal applicable when used in a negative connotation to refer to the complete or near complete lack of an action, characteristic, property, state, structure, item, or result. For example, an element, combination, embodiment, or composition that is "substantially free of" or "generally free of" an ingredient or element may still actually contain such item as long as there is generally no measurable effect thereof.

In the forgoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equally entitled.

The invention claimed is:

1. A drilling rig comprising:
at least two lifting devices;
a crown block;
a traveling block;
a top drive;
a mast;
a substructure;
a racking platform,
wherein the mast comprises a base section and a first section, a second section, a third section and a fourth sectional,
the base section connects to the substructure,
the crown block is installed on the fourth section and the traveling block connects to the crown block,
the third section is installed with the racking platform,
the second section connects to the third section, and the first section connects to the second section, and the first section connects to the base section,
a lower region of each of the first section, the second section, the third section, and the fourth section is provided with a lifting lug,
wherein each of a front pillar and a rear pillar of the fourth section, a front pillar and a rear pillar of the third section, a front pillar and a rear pillar of the second section, and a pillar of the first section are provided with a lifting lug and a pin hole; wherein each of the pin holes is configured to form a pin connection with an adjacent section,
wherein a fixed pulley block and a guide pulley are connected to the base section,
wherein each of the lifting lug on the first section, the lifting lug on the second section, the lifting lug on the third section, and the lifting lug on the fourth section are each connected to a movable pulley block,
wherein a lifting steel rope from the lifting devices wound around the guide pulleys, the movable pulley block, and the fixed pulley block, and a head of the rope is affixed to a top of the movable pulley block.

2. The drilling rig of claim 1, wherein said substructure comprises a middle module with a hydraulic rotary table, a middle base, a right transportable module, and a left transportable module, wherein the left transportable module comprises a left bottom base and a left top base, the right transportable module comprises a right bottom base and a right top base; a substructure bottom comprises a right bottom base and a left bottom base and a pull rod; the pull rod connects to the right bottom base and the left bottom base; the base section connects to the substructure bottom, and a substructure top which comprises the right top base and the left top base, the middle module is lifted by the lifting devices along the base section.

3. The drilling rig of claim 2 comprising a guide rail and two guide rail grooves, wherein the guide rail is installed on the base section pillar outer surface, and the two guide rail grooves are respectively provided on a left door and right door on a tope of the substructure, the substructure top guide rail grooves is slidably installed on the guide rail for lifting, and at least two walking devices walking in multi-direction are installed on a bottom of a right bottom base and a left bottom base of the substructure.

4. The drilling rig of claim 3, wherein said lifting devices are hydraulic winch or hydraulic cylinder installed on the substructure bottom.

5. The drilling rig of claim 1, wherein said mast is a K-type mast with the mast bottom section larger than mast top section; and a fourth outer frame fits with the fourth section, a third outer frame fits with the third section, a second outer frame fits with the second section, a first outer frame fits with the first section, and a guide rail strip made from a wear-resistant material is installed on the third section, the second section, the front pillar and the rear pillar of the first section, and on a surface of the fourth outer frame, and an aligning plate is affixed to the front pillar and the rear pillar of the base section, and the guide rail strip slides on the aligning plate when a section is being lifted.

6. The drilling rig of claim 5, wherein said lifted section is supported by supporting block assembly comprising a supporting block, a handle, and a cushion block, wherein the cushion block is connected to a base section cross beam, the supporting block is hinged with the front pillar and the rear pillar of the base section, the handle is connected to the supporting block and is pulled to drive the supporting block to rotate around hinge until a supporting block bottom touches the cushion block.

7. The drilling rig of claim 6, further comprising a clamping block assembly, wherein the base section is installed with the clamping block assembly above the supporting block to clamp the first section lower beam after the first section is lifted.

8. The drilling rig of claim 7, further comprising a pair of movable door bolts installed on the two front pillars of the base section to hold and align the lifted section.

9. The drilling rig of claim 8, further comprising two winches installed on the base section.

10. The drilling rig of claim 9, further comprising a mounting rack wherein the mounting rack comprises a rack body, a guide rail, a supporting leg, and a platform guide rail, when any one among the third section, the second section, the first section is being lifted, a pulley is installed in the pin hole of the rear pillar of such a section, and the pulley is driven to slide on the guide rail and the platform guide rail of the mounting rack during the substantially vertical lifting of the adjacent upper section.

* * * * *